US011827418B2

(12) United States Patent
Tang

(10) Patent No.: US 11,827,418 B2
(45) Date of Patent: Nov. 28, 2023

(54) BAG AND RELATED METHODS

(71) Applicant: Tecksom International Limited, Nassau (BS)

(72) Inventor: Luen Sing Tang, New Territories (HK)

(73) Assignee: TECKSOM INTERNATIONAL LIMITED, Nassau (BS)

( * ) Notice: Subject to any disclaimer, the term of this patent is extended or adjusted under 35 U.S.C. 154(b) by 0 days.

(21) Appl. No.: 17/279,123

(22) PCT Filed: Sep. 25, 2019

(86) PCT No.: PCT/IB2019/058110
§ 371 (c)(1),
(2) Date: Mar. 24, 2021

(87) PCT Pub. No.: WO2020/065542
PCT Pub. Date: Apr. 2, 2020

(65) Prior Publication Data

US 2021/0394965 A1 Dec. 23, 2021

(30) Foreign Application Priority Data

Sep. 25, 2018 (AU) ..... 2018903605

(51) Int. Cl.
*B65D 33/20* (2006.01)
*B65D 30/20* (2006.01)
*B65D 33/24* (2006.01)

(52) U.S. Cl.
CPC ..... *B65D 33/20* (2013.01); *B65D 31/10* (2013.01); *B65D 33/24* (2013.01)

(58) Field of Classification Search
CPC ..... B65D 33/10; B65D 31/10; B65D 33/24
USPC ..... 383/42
See application file for complete search history.

(56) References Cited

U.S. PATENT DOCUMENTS

| | | | | |
|---|---|---|---|---|
| 2006/0162289 | A1* | 7/2006 | Shepard | B65B 61/188 53/469 |
| 2011/0185543 | A1 | 8/2011 | Suckow et al. | 24/389 |
| 2013/0078401 | A1 | 3/2013 | Tang | 428/34.1 |

FOREIGN PATENT DOCUMENTS

| | | | | |
|---|---|---|---|---|
| CN | 1222473 | A | 7/1999 | |
| CN | 1478037 | A | 2/2004 | |
| DE | 102005026149 | A1 * | 3/2006 | B31B 19/36 |
| DE | 202007018095 | U1 * | 4/2008 | B65D 31/10 |
| EP | 0516393 | A1 | 12/1992 | |
| EP | 0834454 | A1 * | 4/1998 | |
| JP | H06-92362 | A | 4/1994 | |
| JP | 2005-225541 | A | 8/2005 | |

(Continued)

OTHER PUBLICATIONS

Machine translation of DE-102005026149-A1.*

(Continued)

*Primary Examiner* — Jes F Pascua
(74) *Attorney, Agent, or Firm* — OSTROLENK FABER LLP

(57) ABSTRACT

A bag wherein in a first mode the mouth of the bag has a perimeter defined by the front panel and back panel and two sides of the bag closure. Strips at the mouth are not configured to close the bag in the first mode. The bag also has a second mode. This allows a second mode opening to the bag's containment region to be created. The perimeter of the second mode opening is defined by the two mutually engageable closure strips.

29 Claims, 21 Drawing Sheets

(56) References Cited

FOREIGN PATENT DOCUMENTS

| | | | | |
|---|---|---|---|---|
| WO | WO-2004083065 A1 * | 9/2004 | ..... | B65D 31/10 |
| WO | WO 2010/003233 A1 | 1/2010 | | |
| WO | WO-2016114303 A1 * | 7/2016 | ..... | A44B 19/16 |

OTHER PUBLICATIONS

Machine translation of DE-202007018095-U1.*
International Search Report dated Dec. 13, 2019 in corresponding PCT International Application No. PCT/IB2019/058110.
Written Opinion dated Dec. 13, 2019 in corresponding PCT International Application No. PCT/IB2019/058110.
Search Report dated Jul. 29, 2019 in corresponding Australian Provisional Patent Application No. 2018903605.

* cited by examiner

BAG AND RELATED METHODS

CROSS-REFERENCE TO RELATED APPLICATIONS

The present application is a 35 U.S.C. §§ 371 national phase conversion of PCT/IB2019/058110, filed Sep. 25, 2019, which claims priority to Australian Provisional Patent Application No. 2018903605, filed Sep. 25, 2018, the contents of which are incorporated herein by reference. The PCT International Application was published in the English language.

FIELD OF THE INVENTION

The present invention relates to bags or packaging, and to materials and methods for their manufacture and use. In particular but not solely, the present invention relates to bags for food packaging, and to bags having differently sized and featured openings in different states.

BACKGROUND TO THE INVENTION

Bags, and particularly plastic bags are commonly used for holding, transporting, and storing products. Plastic bags are versatile, and used widely in a vast array of applications including particularly for containing food.

For many uses it is desirable to have some form of closure, so that the bag can be opened and re-closed by a consumer. This allows the contents of the bag to remain fresh, to avoid contamination, or to facilitate further transportation or storage without spillage. A zip-closure is commonly used form of closure to provide an airtight or substantially airtight seal of a bag.

While the presence of a closure may provide advantages to a consumer, it may complicate the filling of the bag by the producer. The parts of the closure, such as the halves of a plastic zip, may be provided joined together and require a production step to unjoin them before the bag is open and can be filled.

The parts of the closure may also be naturally biased towards each other. This effect may be caused by the end-regions of a plastic zip which are joined to each other. Because the end regions are prevented from separating, they may bias more inward portions of the closures towards each other. Both this and the natural constriction at the end-regions of the closures which are joined to each other can operate to reduce the size of the opening available for filling.

Attempts to expand the opening may cause the end-regions of the plastic zip to separate from each other, meaning that the bag will no longer be able to be sealed closed.

Aside from any constriction of the opening, plastic bags with closures also have the problem that the closure parts are exposed when the bag is being filled. This may result in contamination of the closure parts by whatever the bag is being filled with. For example, zip halves of a plastic zip closure bag are exposed as the bag is filled. Particularly if the bag is filled with a liquid, a powder or granulated substance such as flour or ground coffee, some of this material may be caught in either half of the zip. This may prevent the zip from sealing together, and result in spoiling of the contents or their leakage from the bag.

It is an object of the present invention to provide a bag and related methods of construction and/or use which overcomes or at least partially ameliorates some of the abovementioned disadvantages, or which at least provides the public with a useful choice.

Alternately or additionally, it is an object of the present invention to provide a bag with a large first mode opening to enable filling of the bag, and a smaller second mode opening for use by a consumer and which is sealable by a closure.

Alternately or additionally, it is an object of the present invention to provide a bag having a closure wherein the elements of the closure are protected from contamination during the filling of the bag with its contents.

Alternately or additionally, it is an object of the present invention to provide a bag with a large first mode opening to enable filling of the bag, and a smaller second mode opening which is sealable by a closure, and where the elements of the closure are protected from contamination during the filling of the bag with its contents.

Alternatively or additionally, it is an object of the present invention to provide a bag which is heat sealed across a top of the bag and openable at a closure of the bag, wherein gussets of the bag are sealed closed at the top of the bag but are not inhibited from expanding or collapsing.

Alternatively or additionally, it is an object of the present invention to provide a bag having a closure in two parts, wherein in a first mode the two parts of the closure are both associated with one face of the bag such that a first mode opening of the bag is defined around rather than between the two parts of the closure, and in a second mode one part of the closure is transferred to another face of the bag, and a second mode opening of the bag is defined between the two parts of the closure.

Alternatively or additionally, it is an object of the present invention to provide a method of transferring one half of a closure of a bag between a first mode in which the two halves are associated with one part of the bag and the bag is openable past the closure and a second mode in which each half of the zip is associated with respective opposing parts of the bag, and the bag is openable between the halves of the closure.

Alternatively or additionally, it is an object of the present invention to provide a closure subassembly of or for a bag.

Alternatively or additionally, it is an object of the present invention to provide a method of manufacturing a closure subassembly of or for a bag.

For the purposes of this specification, the term "plastic" shall be construed to mean a general term for a wide range of synthetic or semisynthetic polymerization products, and generally consisting of a hydrocarbon-based polymer.

For the purpose of this specification, where method steps are described in sequence, the sequence does not necessarily mean that the steps are to be chronologically ordered in that sequence, unless there is no other logical manner of interpreting the sequence.

SUMMARY OF THE INVENTION

In a first aspect, the present invention may be said to broadly consist in a bag comprising a front panel and back panel sealed at a base of the bag and two sides extending from the base to define a containment region, the bag open or openable at an opening region opposite the base and where a multi-panel assembly is provided or defined comprised of said front panel and back panel, at least one side being of a gusset formation, a first closure panel comprising a closure element for cooperating with a closure element associated with the back panel to provide an openable and re-closable closure of the opening region, and a non-bonding zone at which the back panel and the first closure panel are prevented from bonding to each other under an application of heat and pressure, the non-bonding zone being located along the length of the openable and re-closable closure, and more distal of the base of the bag than the openable and re-closable closure, wherein in a first mode the first closure panel is associated with the back panel, and the containment region is accessible through a first mode opening the perimeter of which is defined by the front panel and back panel and two sides, and wherein in a second mode, following an application of heat and pressure along the non-bonding zone to the back panel and the first closure panel and the remainder of the multi-panel assembly, the first closure panel is bonded to the remainder of the multi-panel assembly such that a second mode opening to the containment region is able to be created between the closure element of the back panel and the closure element of the first closure panel, and the perimeter of the second mode opening is defined by the two closure elements.

Preferably the remainder of the multi-panel assembly comprises the front panel and the two sides.

Preferably the remainder of the multi-panel assembly comprises the front panel and the at least one side being of a gusset formation.

Preferably the remainder of the multi-panel assembly to which the first closure panel is bonded comprises a folded portion of the at least one side being of a gusseted formation directly adjacent the first closure panel and a remainder of the front panel not covered by the folded portion of each at least one side being of a gusset formation.

Preferably each of the two sides are of a gusset formation.

Preferably the remainder of the multi-panel assembly to which the first closure panel is bonded comprises a) a portion of the gusseted formation of each side at respective periphery of the first closure panel, and b) a remainder of the front panel not occluded by the gusset formations of the two sides.

Preferably the closure elements of the openable and re-closable closure are prevented from bonding to each other under an application of heat and pressure.

Preferably the perimeter of the second mode opening is smaller than the perimeter of the first mode opening.

Preferably the perimeter of the second mode opening is smaller than the perimeter of the first mode opening by an amount substantially equal to a width or total widths of the at least one side being of a gusset formation.

Preferably in the second mode the second mode opening to the containment region which is able to be created is selectively openable and re-closable at the openable and re-closable closure.

Preferably the non-bonding zone extends substantially across the opening region of the bag.

Preferably the first closure panel is bondable under heat and pressure to the remainder of the multi-panel assembly.

Preferably the bonding of the first closure panel to the remainder of the multi-panel assembly at the non-bonding zone by the application of heat and pressure is provided by a material relationship between the first closure panel and the remainder of the multi-panel assembly.

Preferably the prevention of the back panel and the first closure panel from bonding to each other is provided by a separator at the non-bonding zone between the back panel and the first closure panel, the separator insulating the back panel and the first closure panel at the non-bonding zone from bonding with each other.

Preferably the prevention of the back panel and the first closure panel from bonding to each other at the non-bonding zone is provided by a material relationship between the back panel and the first closure panel which does not bond under heat and pressure.

Preferably the material relationship is provided by either or both of the back panel and the first closure panel at the non-bonding zone comprising a non-thermoplastic material.

Preferably the non-thermoplastic material is provided as a surface addition to either or both of the back panel and the first closure panel at the non-bonding zone.

Preferably the non-thermoplastic material is provided integral with either or both of the first closure panel and the second closure panel at the non-bonding zone.

Preferably the non-thermoplastic material is provided as a replacement of an outer ply of either or both of the back panel and the first closure panel at the non-bonding zone.

Preferably the closure element associated with the back panel is of the back panel.

Preferably in the first mode the first closure panel is associated with the back panel by the cooperation of the closure element of the first panel and the closure element associated with the back panel.

Preferably in the first mode the first closure panel is associated with the back panel by a bonding of the first closure panel to the back panel along a zone more distal the base than the non-bonding zone.

Preferably the back panel comprises a second closure panel, the second closure panel comprising the closure element associated with the back panel, and the prevention of the first closure panel and the back panel from bonding to each other comprises a prevention of the first closure panel and second closure panel from bonding to each other at the void zone.

Preferably the second closure panel is heat-seal bonded to the back panel.

Preferably the second closure panel is heat-seal bonded to the back panel at either or both of a) the non-bonding zone, and b) a zone more distal the base of the bag than the non-bonding zone.

Preferably in the first mode the first closure panel is associated with the second closure panel by the cooperation of the closure element of the first panel and the closure element associated with the back panel.

Preferably in the first mode the first closure panel, second closure panel, and the back panel are bonded together at the opening region along a zone more distal the base than the non-bonding zone.

Preferably the prevention of the first closure panel and the second closure panel from bonding to each other is provided by a separator at the non-bonding zone between the back panel and the first closure panel, the separator insulating the first closure panel and the second closure panel at the non-bonding zone from bonding with each other.

Preferably the prevention of the first closure panel and the second closure panel from bonding to each other at the non-bonding zone is provided by a material relationship between the first closure panel and the second closure panel which does not bond under heat and pressure.

Preferably the material relationship is provided by either or both of the first closure panel and the second closure panel at the non-bonding zone comprising a non-thermoplastic material.

Preferably the non-thermoplastic material is provided as a surface addition to either or both of the first closure panel and the second closure panel at the non-bonding zone.

Preferably the non-thermoplastic material is provided integral with either or both of the first closure panel and the second closure panel at the non-bonding zone.

Preferably the non-thermoplastic material is provided as a replacement of an outer ply of either or both of the first closure panel and the second closure panel at the non-bonding zone.

Preferably the second closure panel is bonded to the back panel at a zone more distal the base than the non-bonding zone.

Preferably in the first mode the first closure panel is associated with the second closure panel by the cooperation of the closure element of the first panel and the closure element associated with the back panel.

Preferably in the first mode the first closure panel, second closure panel, and the back panel are bonded together at the opening region along a zone more distal the base than the non-bonding zone.

Preferably each panel of the multi-panel assembly, being the back panel, the front panel, the at least one side being of a gusset formation, the first closure panel and a or the second closure panel, comprise two opposed major surfaces.

Preferably each panel of the multi panel assembly comprises either a) a single ply and is bondable at each major surface to another panel of the multi-panel assembly under an application of heat and pressure, or b) multiple plies, and at least one major surface is bondable to another panel of the multi-panel assembly under an application of heat and pressure.

Preferably the multiple plies comprise a first ply facing the containment region and a second ply, wherein the second ply is less stretchable than the first ply, and the first ply is bondable to a thermoplastic material under an application of heat and pressure.

Preferably the multiple plies comprise a first ply and a second ply, wherein the second ply is less stretchable than the first ply, and the first ply is bondable to another panel of the multi-panel assembly under an application of heat and pressure.

Preferably the second ply is less elastic than the first ply.

Preferably the second ply is of a material having a greater Youngs modulus than that of the first ply.

Preferably the second ply is not bondable to a thermoplastic material under an application of heat and pressure.

Preferably the second ply is not bondable to another panel of the multi-panel assembly under an application of heat and pressure.

Preferably the second ply comprises a non-thermoplastic material.

Preferably the second ply comprises one or more of polyethylene terephthalate, nylon, or aluminium.

Preferably back panel, front panel, and at least one side being of a gusset formation each comprise the first ply and the second ply, and are arranged such that the first ply of each faces the containment region.

Preferably the first ply comprises a thermoplastic material.

Preferably first ply comprises one or more of polyethylene and polypropylene.

Preferably the multiple plies comprise the second ply located between the first ply and a third ply.

Preferably the third ply is bondable to another panel of the multi-panel assembly under an application of heat and pressure.

Preferably the third ply comprises a thermoplastic material.

Preferably the third ply comprises one or more of polyethylene and polypropylene.

Preferably the at least one side being of a gusset formation comprises the second ply located between the first ply and a third ply, wherein the third ply is not bondable to another panel of the multi-panel assembly under an application of heat and pressure, and the at least one side being of a gusset formation is configured so the third ply faces away from the containment region.

Preferably at the void zone the second ply of at least one of the panels of the multi-panel assembly is comprised of two unconnected pieces with substantially abutting adjacent edges to define a line of weakness at the void zone along which the panel or multi-panel assembly is tearable.

Preferably at the void zone the second ply of each of the panels of the multi-panel assembly each comprise of two unconnected pieces with substantially abutting adjacent edges and each of the substantially abutting adjacent edges are aligned to define a line of weakness of the multi-panel assembly at the void zone along which the multi-panel assembly is tearable.

Preferably the application of heat and pressure along the non-bonding zone prior to the second mode comprises an application of heat and pressure across the entire width of the first closure panel at the opening region.

Preferably the application of heat and pressure at the non-bonding zone prior to the second mode seals the first closure panel to the remainder of the multi-panel assembly.

Preferably each panel of the multi-panel assembly comprises a plastic material.

Preferably the application of heat and pressure comprises a plastic welding.

Preferably the plastic welding is selected from one or more of a contact welding, an infrared welding, an ultrasonic welding, a hot gas welding, and a heat sealing.

Preferably a bonding comprises a heat sealing.

Preferably a prevention from bonding comprises a prevention from heat sealing.

Preferably a prevention from heat sealing is provided by a non-heat-sealable material relationship.

Preferably a prevention from heat sealing is provided by at least one of the materials to be prevented from heat sealing comprising a non-thermoplastic material.

Preferably panels of the multi-panel assembly which are bonded each other have a heat-sealable relationship.

Preferably when a ply of a panel of the multi-panel assembly bondable to another panel of the multi-panel assembly under an application of heat and pressure the ply and the another panel of the multi-panel assembly have a heat-sealable relationship.

Preferably panels of the multi-panel assembly which are prevented from bonding or are not bondable to each other under an application of heat and pressure have a non-heat-sealable relationship.

Preferably a ply of a panel of the multi-panel assembly which is prevented from bonding or is not bondable to another panel of the multi-panel assembly under an application of heat and pressure have a non-heat-sealable relationship.

Preferably panels of the multi-panel assembly which are bonded each other under an application of heat and pressure each comprise a thermoplastic material.

Preferably when a ply of a panel of the multi-panel assembly is bondable to another panel of the multi-panel assembly under an application of heat and pressure each of the ply and the another panel of the multi-panel assembly comprise a thermoplastic material.

Preferably the thermoplastic material comprises one or more of polyethylene and polypropylene.

Preferably where panels of the multi-panel assembly are prevented from bonding or are not bondable to each other under an application of heat and pressure, at least one of the panels comprise a non-thermoplastic material.

Preferably where a ply of a panel of the multi-panel assembly is prevented from bonding or is not bondable to another panel of the multi-panel assembly under an application of heat and pressure, either or both of the ply or the another panel of the multi-panel assembly comprise a non-thermoplastic material.

Preferably a non-thermoplastic material comprises one or more of polyethylene terephthalate, nylon, or aluminium.

Preferably in the second mode heat and pressure has also been applied along a header zone of the bag to bond the multi-panel assembly together at the header zone to form a header of the bag, and wherein the header zone is more distal the base of the bag than the non-bonding zone.

Preferably the header of the bag seals the multi-panel assembly together at the header zone to seal off the containment region.

Preferably in the second mode the bag is tearable at the non-bonding zone and along a or the line of weakness to remove the header of the bag and allow the second mode opening to the containment region to be created.

Preferably the at least one side being of a gusset formation comprises at least one fold configured so as to allow the gusset formation to a) fold to a collapsed configuration wherein the front panel and back panel are brought towards each other to reduce the volume of the containment region, and b) unfold from the collapsed configuration to move the front panel and back panel away from each other to increase the volume of the containment region.

Preferably the gusset formation comprises one fold.

Preferably in the collapsed configuration fold of the gusset formation projects inwards into the containment region.

Preferably the at least one fold of the gusset formation extends substantially between the base of the bag and the opening region.

Preferably the base of the bag comprises a base panel sealed to the front panel, the back panel, and the two sides, the base panel comprising a base gusset formation to correspond to the gusset formation of the at least one side being of a gusset formation.

Preferably during the application of heat and pressure along the non-bonding zone prior to the second mode the gusset formation is folded to its collapsed configuration.

Preferably in the second mode following the application of heat and pressure along the non-bonding zone one half of each side being of a gusset formation is bonded to the first closure panel and the other half of the gusset formation is bonded to the front panel.

Preferably in the second mode following the application of heat and pressure along the non-bonding zone each side being of a gusset formation is not bonded to itself.

Preferably each side being of a gusset formation is prevented from bonding to itself at a surface of the side facing away from the containment region.

Preferably the surface of the side facing away from the containment region is non-heat-sealable to itself.

Preferably in the second mode following the application of heat and pressure along the non-bonding zone one half of each side being of a gusset formation is bonded to the first closure panel and the other half of the gusset formation is bonded to the front panel and an opposing surface of each side being of a gusset formation is bonded to itself.

Preferably the closure elements of the openable and re-closable closure comprise both parts of a hook and loop fastener.

Preferably the closure elements of the openable and re-closable closure comprise both parts of a zipper closure.

Preferably the closure elements of the openable and re-closable closure comprise a resilient adhesive closure.

Preferably the openable and re-closable closure comprises a sealable closure.

In another aspect, the present invention broadly consists in a bag comprising a back panel and, at an opening region of the bag and as an assembly with the back panel a first closure panel, each of the back panel and first closure panel comprising at a first zone of the opening region a closure member, the closure members for interfacing together to provide an openable and re-closable closure, the bag further comprising a front panel opposed to the back panel, and two sides, at least one side being a of a gusseted formation, the back panel, front panel and sides extending between a base region and the opening region to define a containment region, wherein at a second zone of the opening region, being a zone more distal of the base region than the first zone, the first closure panel and the back panel are not bonded together and are prevented from heat-seal bonding to each other, and wherein if the bag is heat sealed along the second zone, whereat the first closure panel and the back panel are prevented from heat-seal bonding to each other, the first closure panel is bonded to a corresponding portion of the bag, being the first closure panel adjacent portions of the front panel and the sides when flattened against the first closure panel, and an openable and re-closable mouth opening of the bag is able to be created between the closure members of the first and closure panel and the corresponding portion.

Preferably the corresponding portion of the bag to which the first closure panel is bonded comprises a folded portion of the at least one side being of a gusseted formation directly adjacent the first closure panel and a remainder of the front panel not covered by the folded portion of each at least one side being of a gusset formation.

Preferably each of the two sides are of a gusset formation.

Preferably the corresponding portion of the bag to which the first closure panel is bonded comprises a) a portion of the gusseted formation of each side at respective periphery of the first closure panel, and b) a remainder of the front panel not occluded by the gusset formations of the two sides.

Preferably the closure members of the openable and re-closable closure are prevented from heat seal bonding to each other.

Preferably the perimeter of a second mode opening of the bag, being an opening subsequent to a heat sealing of the bag along the second zone, is smaller than a first mode opening of the bag, being an opening prior to a heat sealing of the bag along the second zone.

Preferably the perimeter of the first mode opening of the bag is defined by the front panel, the back panel, and the two sides.

Preferably the perimeter of the second mode opening of the bag is defined by the front panel and the back panel.

Preferably the second zone extends substantially across the opening region of the bag.

Preferably the first closure panel is heat seal bondable to the corresponding portion of the bag.

Preferably the heat seal bonding of the first closure panel to the corresponding portion of the bag at the second zone is provided by a material relationship between the first closure panel and the corresponding portion of the bag.

Preferably the prevention of the back panel and the first closure panel from heat seal bonding to each other is provided by a separator at the second zone between the back panel and the first closure panel, the separator insulating the back panel and the first closure panel at the second zone from bonding with each other.

Preferably the prevention of the back panel and the first closure panel from heat seal bonding to each other at the second zone is provided by a material relationship between the back panel and the first closure panel which does not heat seal bond.

Preferably the material relationship is provided by either or both of the back panel and the first closure panel at the second zone comprising a non-thermoplastic material.

Preferably the non-thermoplastic material is provided as a surface addition to either or both of the back panel and the first closure panel at the second zone.

Preferably the non-thermoplastic material is provided integral with either or both of the first closure panel and the second closure panel at the second zone.

Preferably the non-thermoplastic material is provided as a replacement of an outer ply of either or both of the back panel and the first closure panel at the second zone.

Preferably the closure member associated with the back panel is of the back panel.

Preferably in the first mode the first closure panel is associated with the back panel by the cooperation of the closure member of the first panel and the closure member associated with the back panel.

Preferably in the first mode the first closure panel is associated with the back panel by a bonding of the first closure panel to the back panel along a zone more distal the base than the second zone.

Preferably the back panel comprises a second closure panel, the second closure panel comprising the closure member associated with the back panel, and the prevention of the first closure panel and the back panel from bonding to each other comprises a prevention of the first closure panel and second closure panel from bonding to each other at the void zone.

Preferably the second closure panel is heat-seal bonded to the back panel.

Preferably the second closure panel is heat-seal bonded to the back panel at either or both of a) the second zone, and b) a zone more distal the base of the bag than the second zone.

Preferably in the first mode the first closure panel is associated with the second closure panel by the cooperation of the closure member of the first panel and the closure member associated with the back panel.

Preferably in the first mode the first closure panel, second closure panel, and the back panel are bonded together at the opening region along a zone more distal the base than the second zone.

Preferably the prevention of the first closure panel and the second closure panel from heat seal bonding to each other is provided by a separator at the second zone between the back panel and the first closure panel, the separator insulating the first closure panel and the second closure panel at the second zone from bonding with each other.

Preferably the prevention of the first closure panel and the second closure panel from heat seal bonding to each other at the second zone is provided by a material relationship between the first closure panel and the second closure panel which does not heat seal bond.

Preferably the material relationship is provided by either or both of the first closure panel and the second closure panel at the second zone comprising a non-thermoplastic material.

Preferably the non-thermoplastic material is provided as a surface addition to either or both of the first closure panel and the second closure panel at the second zone.

Preferably the non-thermoplastic material is provided integral with either or both of the first closure panel and the second closure panel at the second zone.

Preferably the non-thermoplastic material is provided as a replacement of an outer ply of either or both of the first closure panel and the second closure panel at the second zone.

Preferably the second closure panel is bonded to the back panel at a zone more distal the base than the second zone.

Preferably in the first mode the first closure panel is associated with the second closure panel by the cooperation of the closure member of the first panel and the closure member associated with the back panel.

Preferably in the first mode the first closure panel, second closure panel, and the back panel are bonded together at the opening region along a zone more distal the base than the second zone.

Preferably each panel of the bag, being the back panel, the front panel, the at least one side being of a gusset formation, the first closure panel and a or the second closure panel, comprise two opposed major surfaces.

Preferably each panel of the bag comprises either a) a single ply and is heat-seal bondable at each major surface to another panel of the bag, or b) multiple plies, and at least one major surface is heat-seal bondable to another panel of the bag.

Preferably the multiple plies comprise a first ply and a second ply, wherein the second ply is less stretchable than the first ply, and the first ply is heat-seal bondable to another panel of the bag.

Preferably the second ply is less elastic than the first ply.

Preferably the second ply is of a material having a greater Youngs modulus than that of the first ply.

Preferably the second ply is not heat-seal bondable to another panel of the bag.

Preferably the second ply comprises a non-thermoplastic material.

Preferably the second ply comprises one or more of polyethylene terephthalate, nylon, or aluminium.

Preferably back panel, front panel, and at least one side being of a gusset formation each comprise the first ply and the second ply, and are arranged such that the first ply of each faces the containment region.

Preferably the first ply comprises a thermoplastic material.

Preferably first ply comprises one or more of polyethylene and polypropylene.

Preferably the multiple plies comprise the second ply located between the first ply and a third ply.

Preferably the third ply is heat-seal bondable to another panel of the bag.

Preferably the third ply comprises a non-thermoplastic material.

Preferably the third ply comprises one or more of polyethylene terephthalate, nylon, or aluminium.

Preferably the at least one side being of a gusset formation comprises the second ply located between the first ply and a third ply, wherein the third ply is not heat-seal bondable to another panel of the bag, and the at least one side being of a gusset formation is configured so the third ply faces away from the containment region.

Preferably at the void zone the second ply of at least one of the panels of the bag is comprised of two unconnected pieces with substantially abutting adjacent edges to define a line of weakness at the void zone along which the panel or bag is tearable.

Preferably at the void zone the second ply of each of the panels of the bag each comprise of two unconnected pieces with substantially abutting adjacent edges and each of the substantially abutting adjacent edges are aligned to define a line of weakness of the bag at the void zone along which the bag is tearable.

Preferably each panel of the bag comprises a plastic material.

Preferably a prevention from heat seal bonding is provided by a non-heat-sealable material relationship.

Preferably a prevention from heat seal bonding is provided by at least one of the materials to be prevented from heat sealing comprising a non-thermoplastic material.

Preferably when a ply of a panel the bag which is heat seal bondable to another panel of the bag, the ply and the another panel of the bag have a heat-sealable relationship.

Preferably panels of the bag which are prevented from bonding or are not heat seal bondable to each other have a non-heat-sealable relationship.

Preferably a ply of a panel of the bag which is prevented from bonding or is not heat seal bondable to another panel of the bag has a non-heat-sealable relationship with the another panel of the bag.

Preferably panels of the bag which are heat seal bonded each other each comprise a thermoplastic material.

Preferably when a ply of a panel the bag is heat seal bondable to another panel of the bag each of the ply and the another panel of the bag comprise a thermoplastic material.

Preferably the thermoplastic material comprises one or more of polyethylene and polypropylene.

Preferably where panels of the bag are prevented from heat-seal bonding to each other, at least one of the panels comprise a non-thermoplastic material.

Preferably where a ply of a panel of the bag is prevented from bonding or is not heat seal bondable to another panel of the bag, either or both of the ply or the another panel of the bag comprise a non-thermoplastic material.

Preferably a non-thermoplastic material comprises one or more of polyethylene terephthalate, nylon, or aluminium.

Preferably in the second mode a header zone of the bag has also been heat sealed to bond the bag together at the header zone to form a header of the bag, and wherein the header zone is more distal the base of the bag than the second zone.

Preferably the header of the bag seals the bag together at the header zone to seal off the containment region.

Preferably in the second mode the bag is tearable at the second zone and along a or the line of weakness to remove the header of the bag and allow the second mode opening to the containment region to be created.

Preferably the at least one side being of a gusset formation comprises at least one fold configured so as to allow the gusset formation to a) fold to a collapsed configuration wherein the front panel and back panel are brought towards each other to reduce the volume of the containment region, and b) unfold from the collapsed configuration to move the front panel and back panel away from each other to increase the volume of the containment region.

Preferably the gusset formation comprises one fold.

Preferably in the collapsed configuration fold of the gusset formation projects inwards into the containment region.

Preferably the at least one fold of the gusset formation extends substantially between the base of the bag and the opening region.

Preferably the base of the bag comprises a base panel sealed to the front panel, the back panel, and the two sides, the base panel comprising a base gusset formation to correspond to the gusset formation of the at least one side being of a gusset formation.

Preferably during a heat sealing along the second zone the gusset formation is folded to its collapsed configuration.

Preferably following a heat sealing along the second zone one half of each side being of a gusset formation is bonded to the first closure panel and the other half of the gusset formation is bonded to the front panel.

Preferably following a heat sealing along the second zone each side being of a gusset formation is not bonded to itself.

Preferably each side being of a gusset formation is prevented from bonding to itself at a surface of the side facing away from the containment region.

Preferably the surface of the side facing away from the containment region is on-heat-sealable to itself.

Preferably following a heat seal bonding along the second zone one half of each side being of a gusset formation is bonded to the first closure panel and the other half of the gusset formation is bonded to the front panel and an opposing surface of each side being of a gusset formation is bonded to itself.

Preferably the closure members of the openable and re-closable closure comprise both parts of a hook and loop fastener.

Preferably the closure members of the openable and re-closable closure comprise both parts of a zipper closure.

Preferably the closure members of the openable and re-closable closure comprise a resilient adhesive closure.

Preferably the openable and re-closable closure comprises a sealable closure.

In another aspect, the present invention broadly consists in a bag comprising a back panel and, at an opening region of the bag and as an assembly with the back panel, a first closure panel and second closure panel, each closure panel comprising at a first zone of the opening region a closure member, the closure members for interfacing together to provide an openable and re-sealable closure, the bag further comprising a front panel opposed to the back panel, and two sides, at least one being a gusseted side, the front panel, back panel and two sides extending between a base region and the opening region to define a containment region, wherein at a second zone of the opening region, being a zone more distal of the base region than the first zone, the second closure panel is bonded to the back panel and the first closure panel and second closure panel are not bonded together, and are prevented from heat-seal bonding to each other, and wherein if the bag is heat sealed along the second zone, whereat the first closure panel and the second closure panel are prevented from heat-seal bonding to each other, the first closure panel is bonded to a corresponding portion of the bag, being the first closure panel adjacent portions of the front panel and the sides when flattened against the first closure panel, and an openable and re-closable mouth opening of the bag is able to be created between the closure members of the first and second closure panels.

In another aspect, the present invention broadly consists in a method of manufacture of a bag for opening and closing by a user, the method comprising a) providing as a multi-panel assembly a bag comprising a back panel and front panel sealed at a base of the bag and two sides extending from the base to define a containment region, at least one side being of a panel having a gusset formation, wherein a first part of an openable and re-closable closure comprising a first closure element is associated with the back panel and the back panel comprises a second part of the openable and re-closable closure having a second closure element for cooperating with the first closure element, and the bag comprises a void region at which the first part and the back panel are prevented from bonding to each other under an application of heat and pressure, b) introducing an item of commerce into the package through a first state opening of the bag, the perimeter of which is defined by the back panel, the front panel, and the two sides, and c) closing the first state opening by an application of heat and pressure to the multi-panel assembly between the back panel and front panel along the void zone, such that the second part is bonded to the back panel and the first part is bonded to the remaining panels of the multi-panel assembly, and a second state opening is able to be created between the first part and second part, and the perimeter of the second state opening is defined by the first part and second part of the openable and re-closable closure.

Preferably the remaining panels of the multi-panel assembly comprise the front panel and the two sides.

Preferably the remaining panels of the multi-panel assembly comprise the front panel and the at least one side being of a panel having a gusset formation.

Preferably the remaining panels of the multi-panel assembly to which the first part is bonded comprises a folded portion of the at least one side being of a gusseted formation directly adjacent the first part and a remainder of the front panel not covered by the folded portion of each at least one side being of a panel having a gusset formation.

Preferably each of the two sides are panels having a gusset formation.

Preferably the remaining panels of the multi-panel assembly to which the first part is bonded comprises a) a portion of the gusseted formation of each side at respective periphery of the first part, and b) a remainder of the front panel not occluded by the gusset formations of the two sides.

Preferably the closure elements of the openable and re-closable closure are prevented from bonding to each other under an application of heat and pressure.

Preferably the perimeter of the second state opening is smaller than the perimeter of the first state opening.

Preferably the perimeter of the second state opening is smaller than the perimeter of the first state opening by an amount substantially equal to a width or total widths of the at least one side being of a panel having a gusset formation.

Preferably in the second mode the second state opening to the containment region which is able to be created is selectively openable and re-closable at the openable and re-closable closure.

Preferably the void region extends substantially across the opening region of the bag.

Preferably the first part is bondable under heat and pressure to the remaining panels of the multi-panel assembly.

Preferably the bonding of the first part to the remaining panels of the multi-panel assembly at the void region by the application of heat and pressure is provided by a material relationship between the first part and the remaining panels of the multi-panel assembly.

Preferably the prevention of the back panel and the first part from bonding to each other is provided by a separator at the void region between the back panel and the first part, the separator insulating the back panel and the first part at the void region from bonding with each other.

Preferably the prevention of the back panel and the first part from bonding to each other at the void region is provided by a material relationship between the back panel and the first part which does not bond under heat and pressure.

Preferably the material relationship is provided by either or both of the back panel and the first part at the void region comprising a non-thermoplastic material.

Preferably the non-thermoplastic material is provided as a surface addition to either or both of the back panel and the first part at the void region.

Preferably the non-thermoplastic material is provided integral with either or both of the back panel and the first part at the void region.

Preferably the non-thermoplastic material is provided as a replacement of an outer ply of either or both of the back panel and the first part at the void region.

Preferably the closure element associated with the back panel is of the back panel.

Preferably in the first mode the first part is associated with the back panel by the cooperation of the closure element of the first panel and the closure element associated with the back panel.

Preferably in the first mode the first part is associated with the back panel by a bonding of the first part to the back panel along a zone more distal the base than the void region.

Preferably the back panel comprises a second part of the openable and re-closable closure, the second part comprising the closure element associated with the back panel, and the prevention of the first part and the back panel from bonding to each other comprises a prevention of the first part and second part from bonding to each other at the void zone.

Preferably the second part is heat-seal bonded to the back panel.

Preferably the second part is heat-seal bonded to the back panel at either or both of a) the void region, and b) a zone more distal the base of the bag than the void region.

Preferably in the first mode the first part is associated with the second part by the cooperation of the closure element of the first panel and the closure element associated with the back panel.

Preferably in the first mode the first part, second part, and the back panel are bonded together at the opening region along a zone more distal the base than the void region.

Preferably the prevention of the first part and the second part from bonding to each other is provided by a separator at the void region between the back panel and the first part, the separator insulating the first part and the second part at the void region from bonding with each other.

Preferably the prevention of the first part and the second part from bonding to each other at the void region is provided by a material relationship between the first part and the second part which does not bond under heat and pressure.

Preferably the material relationship is provided by either or both of the first part and the second part at the void region comprising a non-thermoplastic material.

Preferably the non-thermoplastic material is provided as a surface addition to either or both of the first part and the second part at the void region.

Preferably the non-thermoplastic material is provided integral with either or both of the back panel and the first part at the void region.

Preferably the non-thermoplastic material is provided as a replacement of an outer ply of either or both of the first part and the second part at the void region.

Preferably the second part is bonded to the back panel at a zone more distal the base than the void region.

Preferably in the first mode the first part is associated with the second part by the cooperation of the closure element of the first panel and the closure element associated with the back panel.

Preferably in the first mode the first part, second part, and the back panel are bonded together at the opening region along a zone more distal the base than the void region.

Preferably each panel of the multi-panel assembly, being the back panel, the front panel, the at least one side being of a panel having a gusset formation, the first part and a or the second part, comprise two opposed major surfaces.

Preferably each panel of the multi panel assembly comprises either a) a single ply and is bondable at each major surface to another panel of the multi-panel assembly under an application of heat and pressure, or b) multiple plies, and at least one major surface is bondable to another panel of the multi-panel assembly under an application of heat and pressure.

Preferably the multiple plies comprise a first ply facing the containment region and a second ply, wherein the second ply is less stretchable than the first ply, and the first ply is bondable to a thermoplastic material under an application of heat and pressure.

Preferably the multiple plies comprise a first ply and a second ply, wherein the second ply is less stretchable than the first ply, and the first ply is bondable to another panel of the multi-panel assembly under an application of heat and pressure.

Preferably the second ply is less elastic than the first ply.

Preferably the second ply is of a material having a greater Youngs modulus than that of the first ply.

Preferably the second ply is not bondable to a thermoplastic material under an application of heat and pressure.

Preferably the second ply is not bondable to another panel of the multi-panel assembly under an application of heat and pressure.

Preferably the second ply comprises a non-thermoplastic material.

Preferably the second ply comprises one or more of polyethylene terephthalate, nylon, or aluminium.

Preferably the back panel, front panel, and at least one side being of a panel having a gusset formation each comprise the first ply and the second ply, and are arranged such that the first ply of each faces the containment region.

Preferably the first ply comprises a thermoplastic material.

Preferably first ply comprises one or more of polyethylene and polypropylene.

Preferably the multiple plies comprise the second ply located between the first ply and a third ply.

Preferably the third ply is bondable to another panel of the multi-panel assembly under an application of heat and pressure.

Preferably the third ply comprises a thermoplastic material.

Preferably the third ply comprises one or more of polyethylene and polypropylene.

Preferably the at least one side being of a panel having a gusset formation comprises the second ply located between the first ply and a third ply, wherein the third ply is not bondable to another panel of the multi-panel assembly under an application of heat and pressure, and the at least one side being of a panel having a gusset formation is configured so the third ply faces away from the containment region.

Preferably at the void zone the second ply of at least one of the panels of the multi-panel assembly is comprised of two unconnected pieces with substantially abutting adjacent edges to define a line of weakness at the void zone along which the panel or multi-panel assembly is tearable.

Preferably at the void zone the second ply of each of the panels of the multi-panel assembly each comprise of two unconnected pieces with substantially abutting adjacent edges and each of the substantially abutting adjacent edges are aligned to define a line of weakness of the multi-panel assembly at the void zone along which the multi-panel assembly is tearable.

Preferably the step of closing the first state opening by an application of heat and pressure along the void region prior to the second mode comprises an application of heat and pressure across the entire width of the first part at the opening region.

Preferably the step of closing the first state opening by an application of application of heat and pressure at the void region prior to the second mode seals the first part to the remaining panels of the multi-panel assembly.

Preferably each panel of the multi-panel assembly comprises a plastic material.

Preferably the application of heat and pressure comprises a plastic welding.

Preferably the plastic welding is selected from one or more of a contact welding, an infrared welding, an ultrasonic welding, a hot gas welding, and a heat sealing.

Preferably a bonding comprises a heat sealing.

Preferably a prevention from bonding comprises a prevention from heat sealing.

Preferably the prevention from heat sealing is provided by a non-heat-sealable material relationship.

Preferably the prevention from heat sealing is provided by at least one of the materials to be prevented from heat sealing comprising a non-thermoplastic material.

Preferably panels of the multi-panel assembly which are bonded each other have a heat-sealable relationship.

Preferably when a ply of a panel of the multi-panel assembly bondable to another panel of the multi-panel assembly under an application of heat and pressure the ply and the another panel of the multi-panel assembly have a heat-sealable relationship.

Preferably panels of the multi-panel assembly which are prevented from bonding or are not bondable to each other under an application of heat and pressure have a non-heat-sealable relationship.

Preferably a ply of a panel of the multi-panel assembly which is prevented from bonding or is not bondable to another panel of the multi-panel assembly under an application of heat and pressure have a non-heat-sealable relationship.

Preferably panels of the multi-panel assembly which are bonded each other under an application of heat and pressure each comprise a thermoplastic material.

Preferably when a ply of a panel of the multi-panel assembly is bondable to another panel of the multi-panel assembly under an application of heat and pressure each of the ply and the another panel of the multi-panel assembly comprise a thermoplastic material.

Preferably the thermoplastic material comprises one or more of polyethylene and polypropylene.

Preferably where panels of the multi-panel assembly are prevented from bonding or are not bondable to each other under an application of heat and pressure, at least one of the panels comprise a non-thermoplastic material.

Preferably where a ply of a panel of the multi-panel assembly is prevented from bonding or is not bondable to another panel of the multi-panel assembly under an application of heat and pressure, either or both of the ply or the another panel of the multi-panel assembly comprise a non-thermoplastic material.

Preferably a non-thermoplastic material comprises one or more of polyethylene terephthalate, nylon, or aluminium.

Preferably in the second mode heat and pressure has also been applied along a header zone of the bag to bond the multi-panel assembly together at the header zone to form a header of the bag, and wherein the header zone is more distal the base of the bag than the void region.

Preferably the header of the bag seals the multi-panel assembly together at the header zone to seal off the containment region.

Preferably in the second mode the bag is tearable at the void region and along a or the line of weakness to remove the header of the bag and allow the second state opening to the containment region to be created.

Preferably the at least one side being of a panel having a gusset formation comprises at least one fold configured so as to allow the gusset formation to a) fold to a collapsed configuration wherein the front panel and back panel are brought towards each other to reduce the volume of the containment region, and b) unfold from the collapsed configuration to move the front panel and back panel away from each other to increase the volume of the containment region.

Preferably the gusset formation comprises one fold.

Preferably in the collapsed configuration fold of the gusset formation projects inwards into the containment region.

Preferably the at least one fold of the gusset formation extends substantially between the base of the bag and the opening region.

Preferably the base of the bag comprises a base panel sealed to the front panel, the back panel, and the two sides, the base panel comprising a base gusset formation to correspond to the gusset formation of the at least one side being of a panel having a gusset formation.

Preferably during the application of heat and pressure along the void region prior to the second mode the gusset formation is folded to its collapsed configuration.

Preferably in the second mode following the application of heat and pressure along the void region one half of each side being of a panel having a gusset formation is bonded to the first part and the other half of the gusset formation is bonded to the front panel.

Preferably in the second mode following the application of heat and pressure along the void region each side being of a panel having a gusset formation is not bonded to itself.

Preferably each side being of a panel having a gusset formation is prevented from bonding to itself at a surface of the side facing away from the containment region.

Preferably the surface of the side facing away from the containment region is non-heat-sealable to itself.

Preferably in the second mode following the application of heat and pressure along the void region one half of each side being of a panel having a gusset formation is bonded to the first part and the other half of the gusset formation is bonded to the front panel and an opposing surface of each side being of a panel having a gusset formation is bonded to itself.

Preferably the closure elements of the openable and re-closable closure comprise both parts of a hook and loop fastener.

Preferably the closure elements of the openable and re-closable closure comprise both parts of a zipper closure.

Preferably the closure elements of the openable and re-closable closure comprise a resilient adhesive closure.

Preferably the openable and re-closable closure comprises a sealable closure.

In another aspect, the present invention broadly consists in a bag having an opening region, a base region, and a containment region, the bag comprising a back panel and an opposed front panel and two sides extending between the base region and the opening region to define the containment region, at least one side being a gusseted side, a closure assembly comprising a first closure panel and second closure panel facing each other, wherein at a void zone of the closure assembly the first and second closure panels are prevented from heat sealing together and wherein at a closure zone of the closure assembly each closure panel comprises a closure member intermediate of the closure panels, the closure members for interfacing with each other to provide an openable and re-closeable closure for the bag, and the void zone is provided more distal of the base region than the sealing zone, wherein in a first state the closure assembly is associated with the back panel and the bag has a first state mouth opening at the opening region, the perimeter of which is defined by the back panel and front panel and the sides, and wherein in a second state, subsequent to a heat sealing of the bag along the void region, the first closure panel is bonded to a corresponding portion of the bag, being the first closure panel adjacent portions of the front panel and the sides when flattened against the second closure panel, such that a second state mouth opening of the bag is able to be created between the first closure panel and second closure panel, the perimeter of the second state mouth opening being defined by the closure member of the first closure panel and the closure member of the second closure panel.

Preferably the corresponding portion of the bag to which the first closure panel is bonded comprises a folded portion of the at least one side being of a gusseted formation directly adjacent the first closure panel and a remainder of the front panel not covered by the folded portion of each at least one side being of a gusset formation.

Preferably each of the two sides are of a gusset formation.

Preferably the corresponding portion of the bag to which the first closure panel is bonded comprises a) a portion of the gusseted formation of each side at respective periphery of the first closure panel, and b) a remainder of the front panel not occluded by the gusset formations of the two sides.

Preferably the closure members of the openable and re-closable closure are prevented from heat seal bonding to each other.

Preferably the perimeter of a second state mouth opening of the bag, being an opening subsequent to a heat sealing of the bag along the void zone, is smaller than a first state opening of the bag, being an opening prior to a heat sealing of the bag along the void zone.

Preferably the perimeter of the first state opening of the bag is defined by the front panel, the back panel, and the two sides.

Preferably the perimeter of the second state mouth opening of the bag is defined by the front panel and the back panel.

Preferably the void zone extends substantially across the opening region of the bag.

Preferably the first closure panel is heat seal bondable to the corresponding portion of the bag.

Preferably the heat seal bonding of the first closure panel to the corresponding portion of the bag at the void zone is provided by a material relationship between the first closure panel and the corresponding portion of the bag.

Preferably the second closure panel is heat-seal bonded to the back panel.

Preferably the second closure panel is heat-seal bonded to the back panel at either or both of a) the void zone, and b) a zone more distal the base of the bag than the void zone.

Preferably in the first state the first closure panel is associated with the second closure panel by the cooperation of the closure member of the first panel and the closure member associated with the back panel.

Preferably in the first state the first closure panel, second closure panel, and the back panel are bonded together at the opening region along a zone more distal the base than the void zone.

Preferably the prevention of the first closure panel and the second closure panel from heat seal bonding to each other is provided by a separator at the void zone between the back panel and the first closure panel, the separator insulating the first closure panel and the second closure panel at the void zone from bonding with each other.

Preferably the prevention of the first closure panel and the second closure panel from heat seal bonding to each other at the void zone is provided by a material relationship between the first closure panel and the second closure panel which does not heat seal bond.

Preferably the material relationship is provided by either or both of the first closure panel and the second closure panel at the void zone comprising a non-thermoplastic material.

Preferably the non-thermoplastic material is provided as a surface addition to either or both of the first closure panel and the second closure panel at the void zone.

Preferably the non-thermoplastic material is provided integral with either or both of the first closure panel and second closure panelat the void zone.

Preferably the non-thermoplastic material is provided as a replacement of an outer ply of either or both of the first closure panel and the second closure panel at the void zone.

Preferably the second closure panel is bonded to the back panel at a zone more distal the base than the void zone.

Preferably in the first state the first closure panel is associated with the second closure panel by the cooperation of the closure member of the first panel and the closure member associated with the back panel.

Preferably in the first state the first closure panel, second closure panel, and the back panel are bonded together at the opening region along a zone more distal the base than the void zone.

Preferably each panel of the bag, being the back panel, the front panel, the at least one side being of a gusset formation, the first closure panel and a or the second closure panel, comprise two opposed major surfaces.

Preferably each panel of the bag comprises either a) a single ply and is heat-seal bondable at each major surface to another panel of the bag, or b) multiple plies, and at least one major surface is heat-seal bondable to another panel of the bag.

Preferably the multiple plies comprise a first ply and a second ply, wherein the second ply is less stretchable than the first ply, and the first ply is heat-seal bondable to another panel of the bag.

Preferably the second ply is less elastic than the first ply.

Preferably the second ply is of a material having a greater Youngs modulus than that of the first ply.

Preferably the second ply is not heat-seal bondable to another panel of the bag.

Preferably the second ply comprises a non-thermoplastic material.

Preferably the second ply comprises one or more of polyethylene terephthalate, nylon, or aluminium.

Preferably back panel, front panel, and at least one side being of a gusset formation each comprise the first ply and the second ply, and are arranged such that the first ply of each faces the containment region.

Preferably the first ply comprises a thermoplastic material.

Preferably first ply comprises one or more of polyethylene and polypropylene.

Preferably the multiple plies comprise the second ply located between the first ply and a third ply.

Preferably the third ply is heat-seal bondable to another panel of the bag.

Preferably the third ply comprises a non-thermoplastic material.

Preferably the third ply comprises one or more of polyethylene terephthalate, nylon, or aluminium.

Preferably the at least one side being of a gusset formation comprises the second ply located between the first ply and a third ply, wherein the third ply is not heat-seal bondable to another panel of the bag, and the at least one side being of a gusset formation is configured so the third ply faces away from the containment region.

Preferably at the void zone the second ply of at least one of the panels of the bag is comprised of two unconnected pieces with substantially abutting adjacent edges to define a line of weakness at the void zone along which the panel or bag is tearable.

Preferably at the void zone the second ply of each of the panels of the bag each comprise of two unconnected pieces with substantially abutting adjacent edges and each of the substantially abutting adjacent edges are aligned to define a line of weakness of the bag at the void zone along which the bag is tearable.

Preferably each panel of the bag comprises a plastic material.

Preferably a prevention from heat seal bonding is provided by a non-heat-sealable material relationship.

Preferably the prevention from heat seal bonding is provided by at least one of the materials to be prevented from heat sealing comprising a non-thermoplastic material.

Preferably when a ply of a panel the bag which is heat seal bondable to another panel of the bag, the ply and the another panel of the bag have a heat-sealable relationship.

Preferably panels of the bag which are prevented from bonding or are not heat seal bondable to each other have a non-heat-sealable relationship.

Preferably a ply of a panel of the bag which is prevented from bonding or is not heat seal bondable to another panel of the bag has a non-heat-sealable relationship with the another panel of the bag.

Preferably panels of the bag which are heat seal bonded each other each comprise a thermoplastic material.

Preferably when a ply of a panel the bag is heat seal bondable to another panel of the bag each of the ply and the another panel of the bag comprise a thermoplastic material.

Preferably the thermoplastic material comprises one or more of polyethylene and polypropylene.

Preferably where panels of the bag are prevented from heat-seal bonding to each other, at least one of the panels comprise a non-thermoplastic material.

Preferably where a ply of a panel of the bag is prevented from bonding or is not heat seal bondable to another panel of the bag, either or both of the ply or the another panel of the bag comprise a non-thermoplastic material.

Preferably a non-thermoplastic material comprises one or more of polyethylene terephthalate, nylon, or aluminium.

Preferably in the second state a header zone of the bag has also been heat sealed to bond the bag together at the header zone to form a header of the bag, and wherein the header zone is more distal the base of the bag than the void zone.

Preferably the header of the bag seals the bag together at the header zone to seal off the containment region.

Preferably in the second state the bag is tearable at the void zone and along a or the line of weakness to remove the header of the bag and allow the second state mouth opening to the containment region to be created.

Preferably each of the first closure panel and second closure panel comprise an extension portion more proximate the base of the bag than the openable and re-closable closure.

Preferably the extension portions are able to be bonded to each other to form a further closure of the bag.

Preferably the bonding is by an adhesive bonding which is able to be separated by a user.

Preferably the bonding is by a resilient adhesive bonding.

Preferably the extension portions are able to be heat seal bonded to each other to form a further closure of the bag.

Preferably either or both of the first closure panel and second closure panel at their extension portions comprise a line of weakness to facilitate the tearing of either or both of the first closure panel and second closure panel to allow access to the containment region of the bag past the further closure.

Preferably the extension portions are heat seal bonded more proximate the base of the bag than the line or lines of weakness.

Preferably the first closure panel and second closure panel are provided for association with the back panel having their extension portions heat seal bonded together.

Preferably the first closure panel and second closure panel are provided for association with the back panel not having their extension portions heat seal bonded together.

Preferably associating the closure assembly with the back panel also comprises the step of heat seal bonding the extension portions together.

Preferably the extension portions are also heat seal bonded to the back panel.

Preferably the further closure is a tamper-evident indicator for a user.

Preferably the further closure is a sealed closure, such as to, prior to its opening by a user, seal the bag irrespective of whether the openable and re-closeable closure is opened or closed.

Preferably the further closure is provided in combination with a header of the bag.

Preferably the at least one side being of a gusset formation comprises at least one fold configured so as to allow the gusset formation to a) fold to a collapsed configuration wherein the front panel and back panel are brought towards each other to reduce the volume of the containment region, and b) unfold from the collapsed configuration to move the front panel and back panel away from each other to increase the volume of the containment region.

Preferably the gusset formation comprises one fold.

Preferably in the collapsed configuration fold of the gusset formation projects inwards into the containment region.

Preferably the at least one fold of the gusset formation extends substantially between the base of the bag and the opening region.

Preferably the base of the bag comprises a base panel sealed to the front panel, the back panel, and the two sides, the base panel comprising a base gusset formation to correspond to the gusset formation of the at least one side being of a gusset formation.

Preferably during a heat sealing along the void zone the gusset formation is folded to its collapsed configuration.

Preferably following a heat sealing along the void zone one half of each side being of a gusset formation is bonded to the first closure panel and the other half of the gusset formation is bonded to the front panel.

Preferably following a heat sealing along the void zone each side being of a gusset formation is not bonded to itself.

Preferably each side being of a gusset formation is prevented from bonding to itself at a surface of the side facing away from the containment region.

Preferably the surface of the side facing away from the containment region is non-heat-sealable to itself.

Preferably following a heat seal bonding along the void zone one half of each side being of a gusset formation is bonded to the first closure panel and the other half of the gusset formation is bonded to the front panel and an opposing surface of each side being of a gusset formation is bonded to itself.

Preferably the closure members of the openable and re-closable closure comprise both parts of a hook and loop fastener.

Preferably the closure members of the openable and re-closable closure comprise both parts of a zipper closure.

Preferably the closure members of the openable and re-closable closure comprise a resilient adhesive closure.

Preferably the openable and re-closable closure comprises a sealable closure.

Preferably prior to the heat sealing a first state opening of the bag is defined at the opening region by the first panel, second panel and the two sides.

Preferably following the heat sealing a second state opening of the bag is able to be created at the opening region, the second state opening being defined by the first panel and the corresponding portion side of the bag.

Preferably the opening following the heat sealing has an openable and re-sealable closure by virtue of the sealing member of the first closure panel which is bonded to the first panel and the corresponding sealing member of the second closure panel which is bonded to the opposite side of the bag.

In another aspect, the present invention broadly consists in an openable and re-closable closure subassembly of or for a bag, the closure subassembly comprising a first film and second film and at a closure region two cooperating closure elements therebetween, one of the closure elements each of to a respective inner surface of each of the first film and second film, wherein a non-bonding region of the inner surfaces of the first film and the second film have a non-heat-sealable relationship, such that at the non-bonding region an outer surface of either film, being a surface opposite the inner surface, may be heat sealed to a third film without a heat-seal bonding of the inner surfaces of first film and second film to each other.

Preferably the closure subassembly comprises a bonding region more distal the closure region than the non-bonding region.

Preferably at the bonding region the inner surfaces of the first film and the second film have a heat-sealable relationship, such that they may be heat sealed to each other.

Preferably at the bonding region both the first film and the second film comprise a thermoplastic material.

Preferably the thermoplastic material comprises one or more of polyethylene and polypropylene.

Preferably the non-bonding region is adjacent to the closure region.

Preferably at the non-bonding region either or both of the first film and the second film comprise a non-thermoplastic material.

Preferably the non-thermoplastic material comprises one or more of polyethylene terephthalate, nylon, or aluminium.

Preferably the non-bonding region extends along at least a substantial portion of the length of the sealable closure.

Preferably either or both of the first film and the second film comprise a laminate of a plurality of sub-films.

Preferably non-heat-sealable relationship is provided by either or both of the first film and the second film at the non-bonding zone comprising a non-thermoplastic material.

Preferably the non-thermoplastic material is provided as a surface addition to either or both of the first film and the second film at the non-bonding zone.

Preferably the non-thermoplastic material is provided integral with either or both of the first film and the second film at the void zone.

Preferably the non-thermoplastic material is provided as a replacement of an outer sub-film of either or both of the first film and the second film at the void zone.

Preferably each of the first closure panel and second closure panel comprise an extension portion more the two cooperating closure elements than the non-bonding zone.

Preferably the extension portions are able to be bonded to each other to form a further closure.

Preferably the bonding is by an adhesive bonding which is able to be separated by a user.

Preferably the bonding is by a resilient adhesive bonding.

Preferably the extension portions are able to be heat seal bonded to each other to form a further closure.

Preferably either or both of the first closure panel and second closure panel at their extension portions comprise a line of weakness to facilitate the tearing of either or both of the first closure panel and second closure panel to allow passage past the further closure.

Preferably the extension portions are heat seal bonded more distal the two cooperating closure elements than the line or lines of weakness.

Preferably the first closure panel and second closure panel are heat seal bonded together.

Preferably the first closure panel and second closure panel are provided for association with a back panel of a bag not having their extension portions heat seal bonded together.

Preferably an association of the closure subassembly with the back panel comprises heat seal bonding the extension portions together.

Preferably the extension portions are also heat seal bonded to the back panel.

Preferably the further closure is a tamper-evident indicator for a user.

In another aspect, the present invention broadly consists in an openable and re-sealable closure subassembly as herein described as part of a bag comprising a back panel, a front panel opposed to the back panel, and two sides, at least one side being a of a gusseted formation, the back panel, front panel and sides extending between a base region and the opening region to define a containment region, wherein the openable and re-sealable closure subassembly is provided at an opening region of the bag and as an assembly with the back panel.

Preferably the second film is heat sealed to the back panel.

Preferably the first and second films are heat sealed to each other at a region more distal the base of the bag than the non-bonding zone.

Preferably the first and second films and the back panel are heat sealed together at a region more distal the base of the bag than the non-bonding region.

Preferably a first mode opening of the bag is defined by the back panel, the front panel, and the two sides.

Preferably elements of the bag or the openable and re-closable closure subassembly which are heat seal bonded each other each comprise a thermoplastic material.

Preferably the thermoplastic material comprises one or more of polyethylene and polypropylene.

In another aspect, the present invention broadly consists in an openable and re-sealable closure subassembly as herein described as part of a bag comprising a back panel, front panel opposed to the back panel, and two sides, at least one side being a of a gusseted formation, the back panel, front panel and sides extending between a base region and the opening region to define a containment region, wherein the second film is heat sealed to the back panel and the first film is heat sealed to the front panel and the at least one side being of a gusseted formation.

Preferably to heat seal the first film to the front panel and the at least one side being of a gusset formation the bag is heat sealed along the non-bonding zone.

Preferably upon the heat sealing along the non-bonding zone to heat seal bond the first film to the front panel and the at least one side being of a gusset formation, the non-heat-sealable relationship of the inner surfaces of the first film and the second film prevents the first film and second film from heat seal bonding to each other at the non-bonding zone.

Preferably a second mode opening of the bag is able to be created between the two cooperating closure elements of the first film and second film.

Preferably elements of the bag or the openable and re-closable closure subassembly which are heat seal bonded each other each comprise a thermoplastic material.

Preferably the thermoplastic material comprises one or more of polyethylene and polypropylene.

The term "axis" as used in this specification means the axis of revolution about which a line or a plane may be revolved to form a symmetrical shape. For example, a line revolved around and axis of revolution will form a surface, while a plane revolved around and axis of revolution will form a solid.

As used herein the term "and/or" means "and" or "or", or both.

As used herein "(s)" following a noun means the plural and/or singular forms of the noun.

The term "comprising" as used in this specification [and claims] means "consisting at least in part of". When interpreting each statement in this specification [and claims] that includes the term "comprising", features other than that or those prefaced by the term may also be present. Related terms such as "comprise" and "comprises" are to be interpreted in the same manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Other aspects of the invention may become apparent from the following description which is given by way of example only and with reference to the accompanying drawings.

BRIEF DESCRIPTION OF THE DRAWINGS

Preferred embodiments of the invention will be described by way of example only and with reference to the drawings, in which.

DETAILED DESCRIPTION OF PREFERRED EMBODIMENTS

Figure 1A:
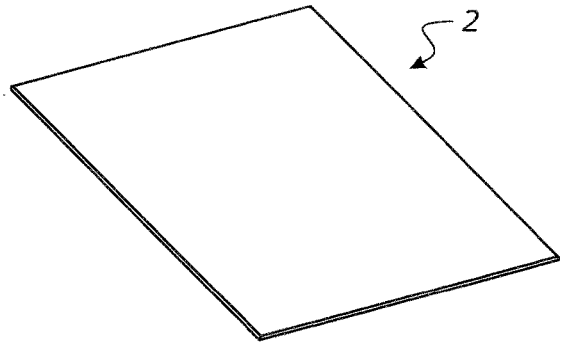
FIG. 1A shows a panel.
Figure 7:
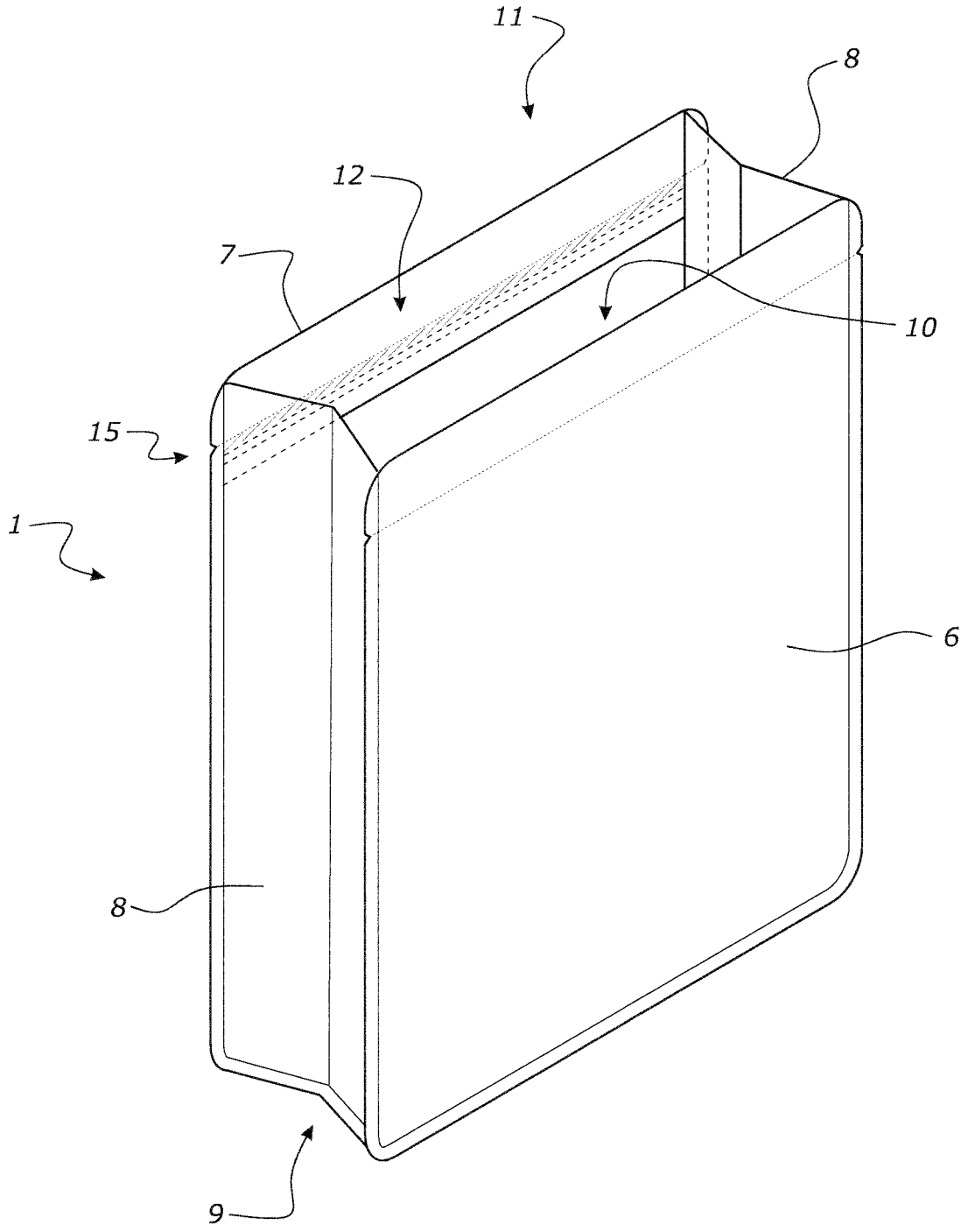
FIG. 7 shows a view of a bag with a first mode opening.

Shown in FIG. 7 is a bag 1. The bag is comprised of a plurality of panels or sheets, such as the panel 2 shown in FIG. 1A. At least some of the panels of the bag are preferably provided as laminate panels, being the laminates of a plurality of sub-panels, films or plies. The panels of the bag and at least some parts of the laminates are preferably of a plastic material.

Figure 1B:
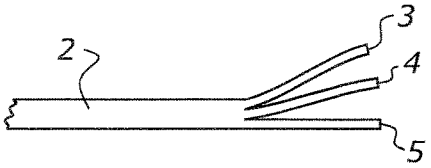
FIG. 1B shows another view of a panel.

FIG. 1B shows an example of a laminate panel 2 comprising a first ply 3, second ply 4 and third ply 5. Differing characteristics, including bonding characteristics, may be provided to the panels or the bag by the provision of plies having different materials, or by laminating the plies in different layups. For example, in one embodiment the first ply 3 and third ply 5, as the outer plies of the laminate panel 2, may comprise a heat-sealable material. The second ply 4 as the internal ply may then be relatively less elastic than the first ply 3 and/or third ply 5. By this configuration the second ply 4 may provide toughness or resilience to the panel 2, while the outer plies 3, 5 are provided for their particular bonding characteristics. The second ply 2 may be of a heat-sealable nature, or may be of a non-heat-sealable nature.

While in various preferred forms the panel 2 comprises a laminate panel, in other embodiments of the invention the panels of the bag may comprise single sub-panels, film or ply.

An embodiment of a bag will now be described with particular reference to FIGS. 7 to 11. The bag of FIG. 7 comprises a front panel 6 and a back panel 7. The bag 1 comprises two sides 8. The front panel, back panel, and two sides extend from a base 9 of the bag to define a containment region 10. As shown in FIG. 7 the bag is open at an opening region 11. The opening region 11 is in preferred embodiments opposite the base 9. At least one of the sides 8 of the bag is of a gusset formation. As seen in FIG. 7, both sides 8 are preferably of a gusset formation.

A multi-panel assembly of the bag comprises the front panel 6 and back panel 7, sides 8 (at least one of which is of a gusset formation) and a first closure panel 12. The first closure panel 12 comprises a closure element 13 for cooperating with a closure element 14 associated with the back panel 7. The closure elements 13 and 14 cooperate with each other to provide an openable and re-closable closure 16 of the opening region 11.

The bag 1 has a non-bonding zone 15, at which the first closure panel 12 and the back panel 7 are prevented from bonding to each other. The bonding is preferably a bonding under an application of heat and pressure, such as a heat sealing. The non-bonding zone 15 is located along the length of the openable and re-closure closure 16. The non-bonding zone 15 is also more distal of the base 9 of the bag 1 than the openable and re-closable closure 16.

In a first mode, the first closure panel 12 is associated with the back panel 7. For example, the first closure panel 12 may be bonded to the back panel 7 at its peripheral portions where it is sealed to the sides of the bag. Or, the first closure panel 12 may be associated with the back panel 7 by way of a connection of the closure element 13 of the first closure panel 12 with the closure element 14 of the back panel 7. In this first mode the containment region 10 of the bag 1 is accessible through a first mode opening. The first mode opening has a perimeter larger than the second mode opening. The first mode opening is preferably defined by the front panel, the back panel, and the two sides.

Because at least one of the two sides 8 comprises a gusset formation, the first mode opening is a gusseted opening. This means that the first mode opening may take advantage of the one or both gusseted sides to provide an expanded opening at the gusset or gussets. Because the first closure panel 12 with its closure element 13 is associated with the back panel 7 and its closure element 14, the first mode opening is an opening past rather than through the openable and re-closable closure 16. The closure elements 13 and 14 may also be protected from contamination by the first closure panel 12 and the back panel 7, as will later be described.

The first mode with its first mode opening which is able to take advantage of the gusset or gussets may be suited to allow for the filling of the bag, such as by a food producer. For example, the first mode opening of the bag may be used to fill it with coffee beans, tea, or any other item or items.

The at least one side having a gusset formation may be configured so that the gusset formation is biased towards an expanded condition, so as to more readily present the first mode opening for filling of the containment region 10. As the first mode opening is not between the closure elements 13 and 14 but rather is past or around them, any joining of the closure elements 13 and 14 to each other at their ends will not restrict the size of the first mode opening, or bias it towards a more closed state.

Figure 8:
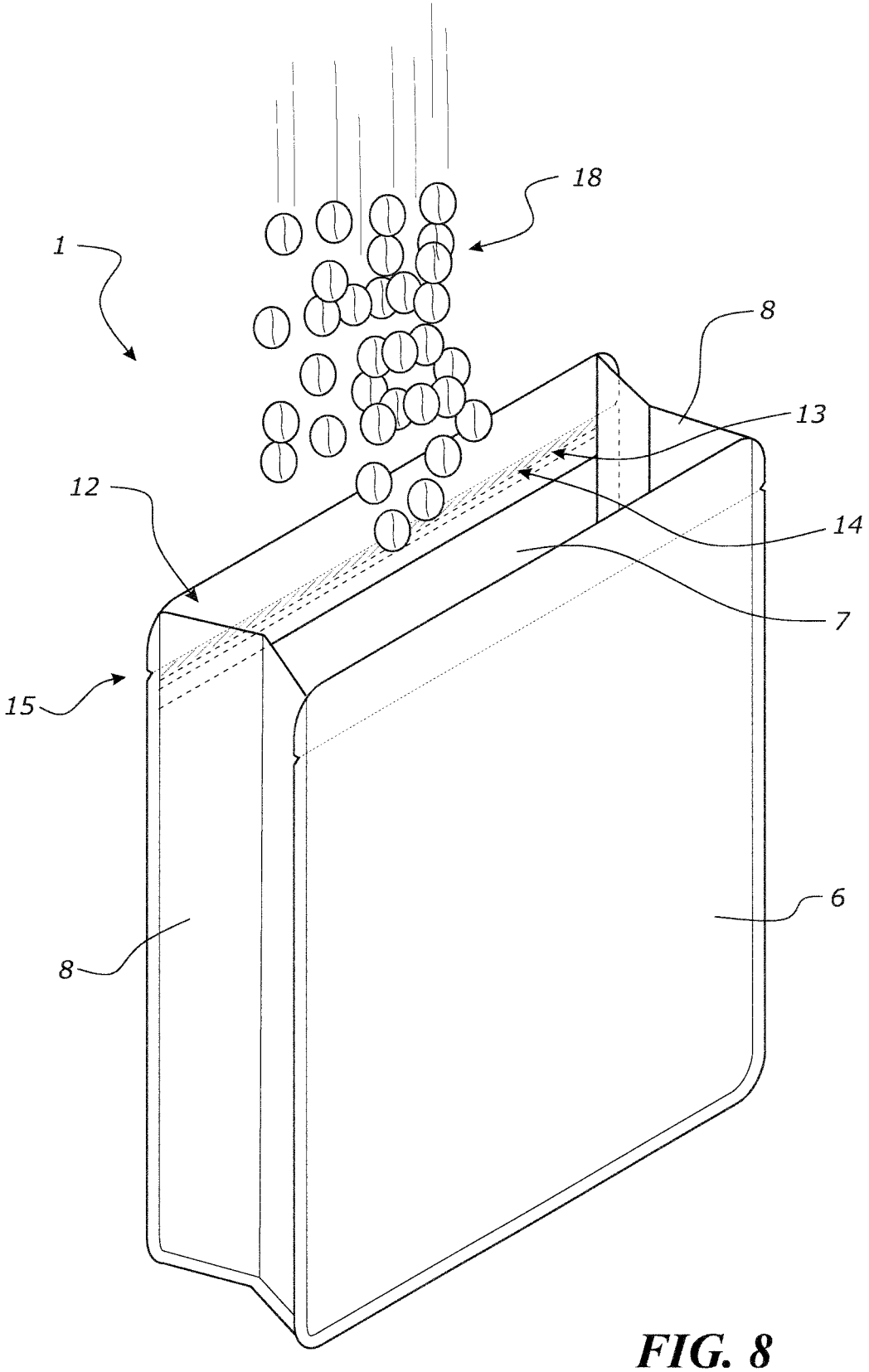
FIG. 8 shows a view of the bag of FIG. 7 being filled with a substance through the first mode opening.

An example of a bag 1 open at the first mode opening and being filled with produce 18, such as coffee beans, is shown in FIG. 8. As seen in FIG. 8, the two sides 8 each comprise a gusset formation, and the gussets are at least partly expanded to increase the size of the first mode opening. The first closure panel 12 and its closure element 13 is associated with the back panel 7, and the first mode opening is past rather than between the closure elements 13 and 14.

The bag 1 also has a second mode. This mode is preferably entered into following the use of the first mode opening to fill the bag with the desired contents. To arrive at the second mode from the first mode, heat and pressure is applied to the bag along the non-bonding zone. The application of heat and pressure is to the panels of the multi-panel assembly of the bag. Because the first closure panel 12 and the back panel 7 are prevented from bonding to each other under an application of heat and pressure at the non-bonding zone 15 (such as because of material selections), they are not bonded to each other.

However, under an application of heat and pressure along the non-bonding zone 15 the first closure panel 12 is bonded to the remainder 22 of the multi-panel assembly. This allows in essence for a transferring of the first closure panel 12 and its half of the openable and re-closable closure 16, the closure element 13, to an opposing portion of the bag defined by the remainder of the multi-panel assembly.

The remainder 22 of the multi-panel assembly is the front panel 6 and the at least one side 8 being of a gusset formation. In the bag of the embodiment of FIGS. 7 and 8, both sides 8 are of a gusset formation, and the gusset formations fold or collapse inwardly of the bag. Thus, when heat and pressure is applied to the bag of FIGS. 7 and 8 across the non-bonding zone 15, the first closure panel 12 is bonded at peripheral portions to the adjacent folded half of each gusseted side 8, and centrally to the front panel 6. In preferred forms, the other half of each gusseted side 8 is bonded to the front panel 6. For example, so as to form the wing portions 21 of FIG. 9.

In some embodiments it may be desirable to form a header 19 of the bag, such as to resiliently seal the bag following its filling or to provide for an indication of tampering. At a header 19 at least some parts of the bag are to be bonded together at a region more distal the base 9 than the non-bonding zone 15.

Figure 9:
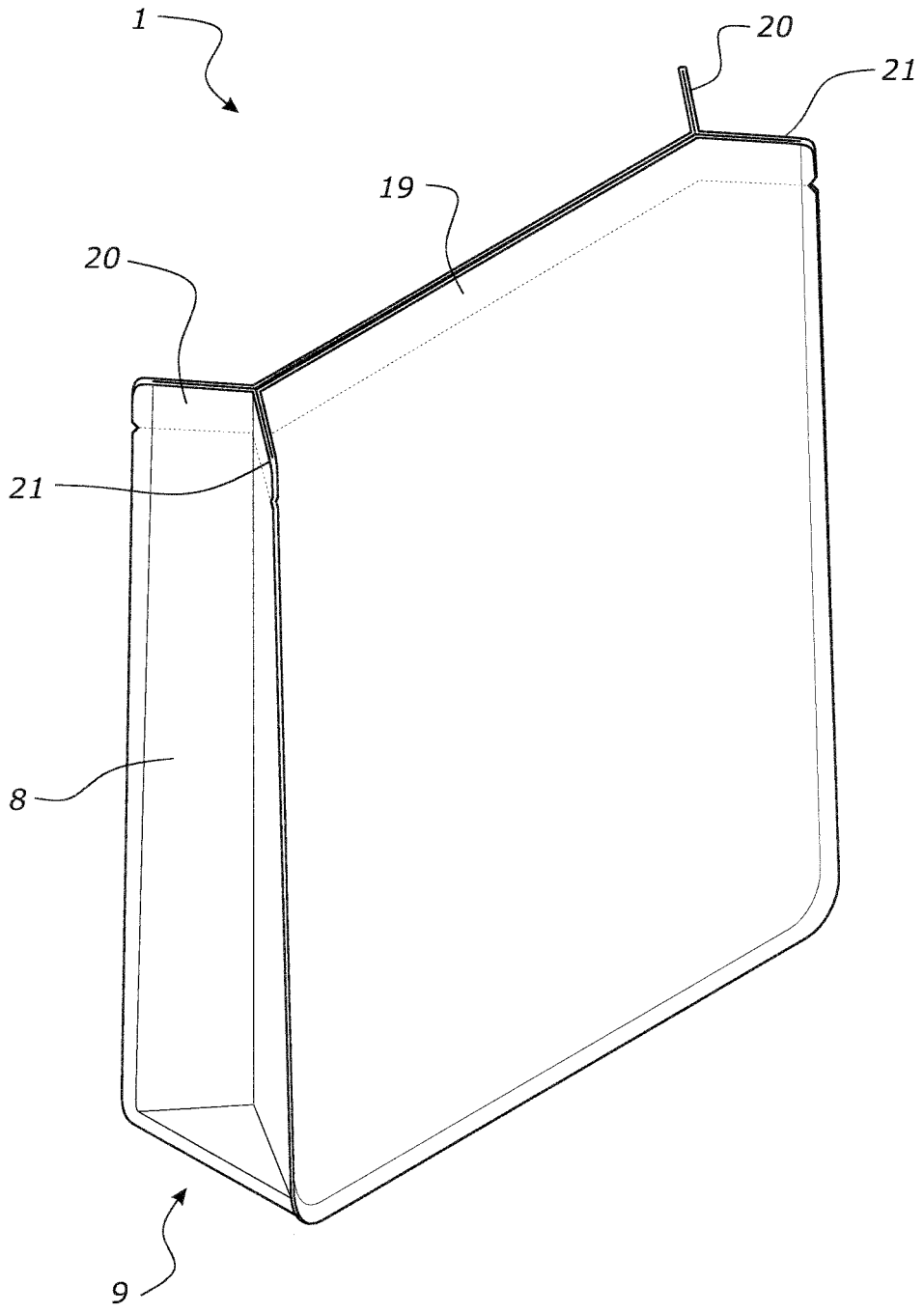
FIG. 9 shows the bag of FIG. 7 or 8 subsequent to an application of heat and pressure to the bag.

For example, one configuration of a header 19 of the bag 1 is shown in FIG. 9. The header 19 is preferably to be formed by the same application of heat and pressure as utilised to transfer the first closure panel 12 from the back panel to the remainder of the multi-panel assembly, but may alternatively be formed by a separate bonding.

As shown in the embodiment of FIG. 9, the parts of the bag 1 more distal the base 9 than the non-bonding zone 15 are able to bond together under an application of heat and pressure. In the embodiment shown in FIG. 9, the outside facing surfaces of the sides 8, each of which have a gusset formation, have not been bonded to each other. As a result, they present as two wing portions 20 and 21. As will be described, such a configuration may have desirable benefits.

A prevention of the gusset formations from bonding to each other, both at the non-bonding zone 15 or at a header zone more distal the non-bonding zone than the base 9, may be provided by a range of methods. These include preventing the gusset formations from bonding to themselves, such as by an insert to isolate them from each other under the application of heat and pressure, or by a material relationship of the gusset to itself, such as at the non-bonding zone 15. The wings 20 and 21 of the gussets may also each be bonded separately, in order to avoid their bonding to each other.

Figure 10:
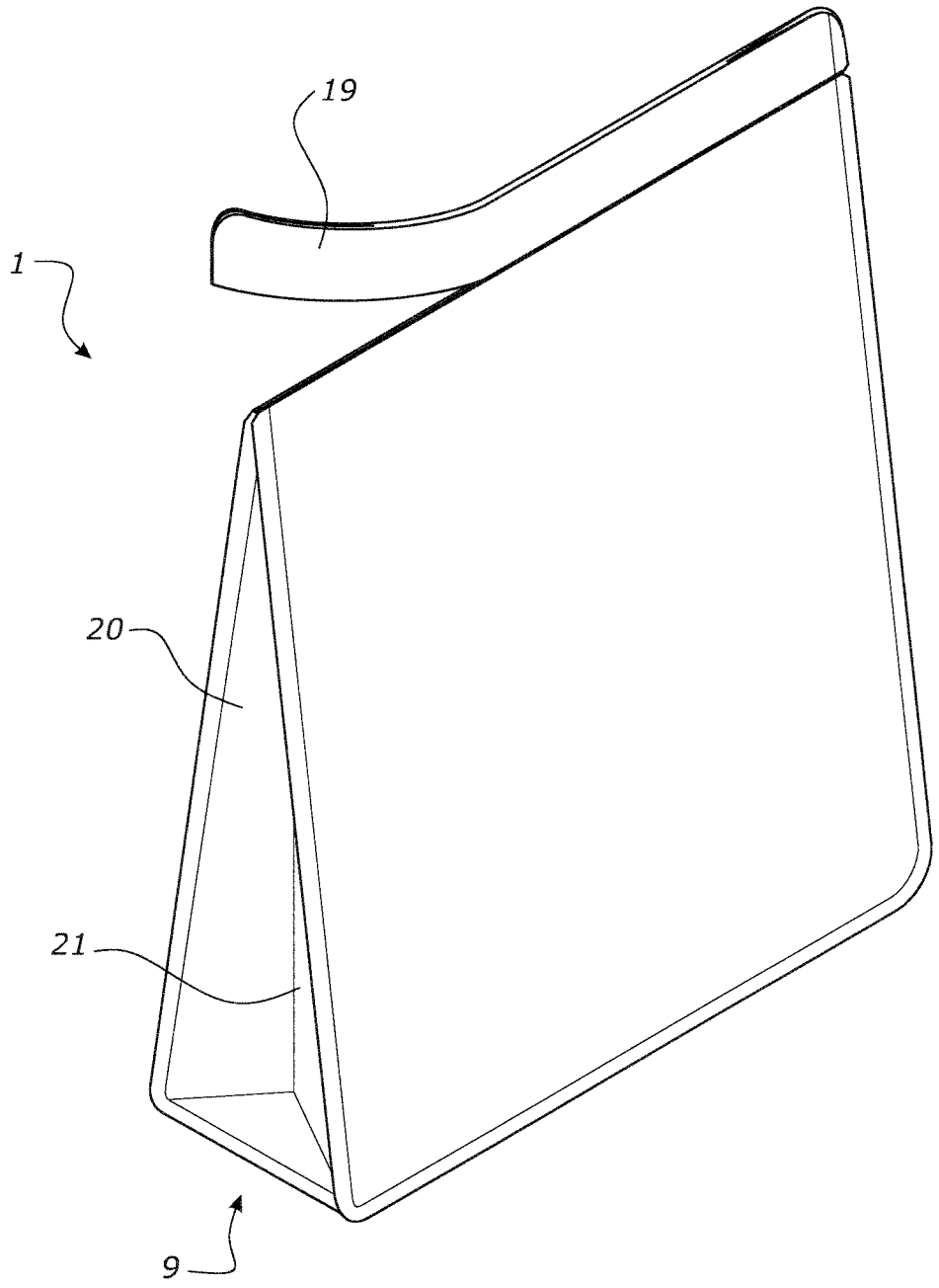
FIG. 10 shows the partial removal of a header of the bag.

Following the application of heat and pressure along the non-bonding zone 15, a second mode opening is able to be defined between the closure element 14 of the back panel and the closure element 13 of the first closure panel. In embodiments having a header 19 more distal the base than the non-bonding zone 15, the header 19 can be removed in order to access the second mode opening. An example of this is shown in FIG. 10.

Figure 11:
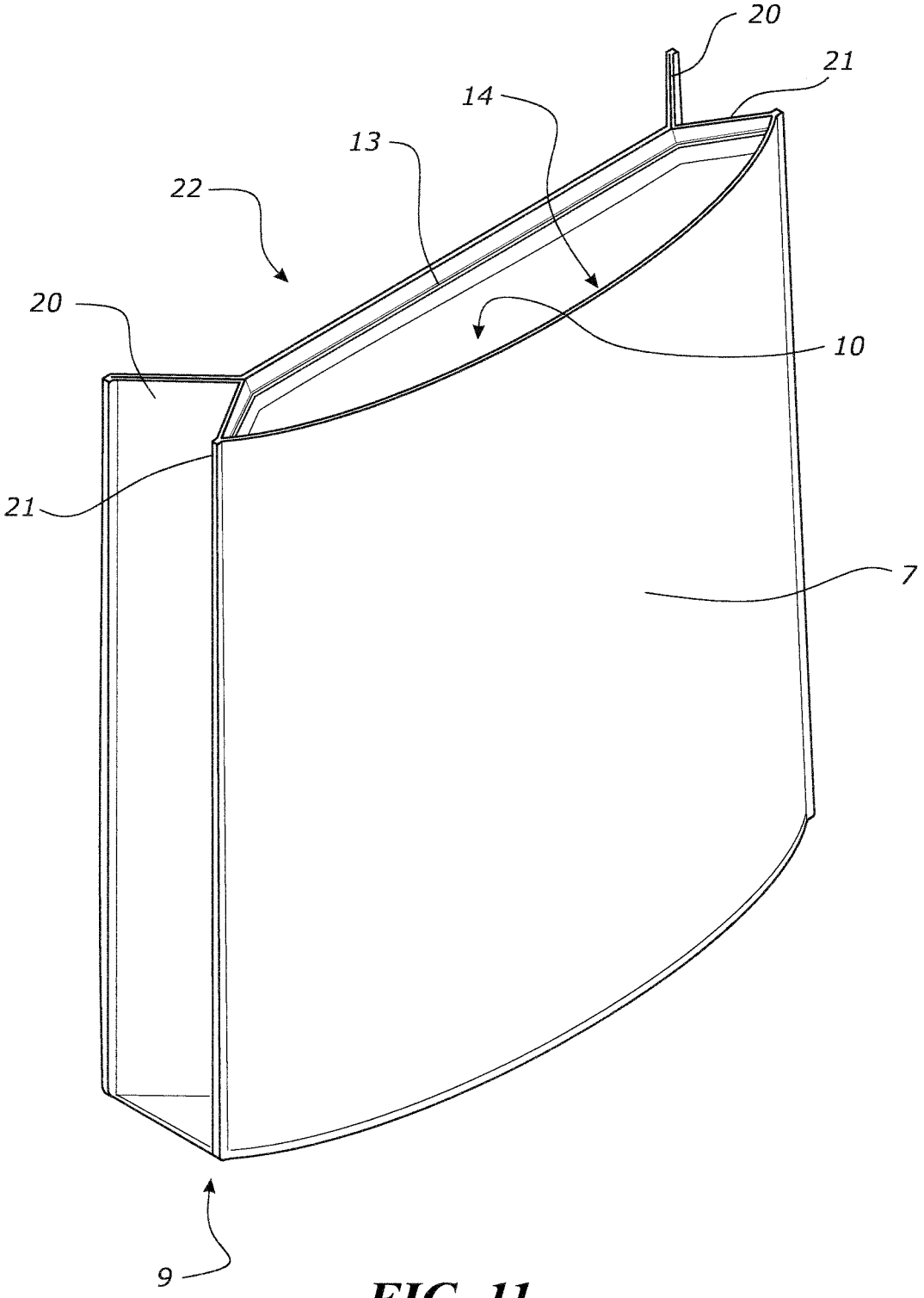
FIG. 11 shows a bag with a second mode opening.

An embodiment of the bag 1 showing the second mode opening is seen in FIG. 11. The second mode opening is defined between the closure elements 13 and 14, where the first closure panel and its closure element 13 is bonded to the remainder 22 of the multi-panel assembly. The perimeter of the second mode opening is defined by the by the two closure elements 13 and 14. The two closure elements may then cooperate with each other to define the second mode opening between the back panel 7 and the remainder 22 of the multi-panel assembly.

Further details of the non-bonding zone 15 will now be described with particular reference to FIGS. 2A-3B.

A non-bonding zone 15 may be to be provided at which the back panel 7 and the first closure panel 12 are prevented from bonding to each other under an application of heat and pressure. One such configuration is the embodiment shown in FIG. 2B, where the first closure panel 12 comprises the strip 17 of material which does not bond under an application of heat and pressure. However, any other range of configurations may be provided within the scope of the invention, so long as the first closure panel 12 and back panel 7 are prevented from bonding to each other under an application of heat and pressure at the non-bonding zone. For example, either or both of the first closure panel and the back panel may comprise the strip 17, either as a surface addition or as a replacement a portion of the either panel. Or, an insert may be provided between the two panels to insulate the two panels from bonding to each other or to the insert under an application of heat and pressure.

While other embodiments are contemplated within the scope of the invention, a first embodiment will now be described wherein the first closure panel 12 comprises the strip 17 of material which does not bond under an application of heat and pressure.

Figure 2A:
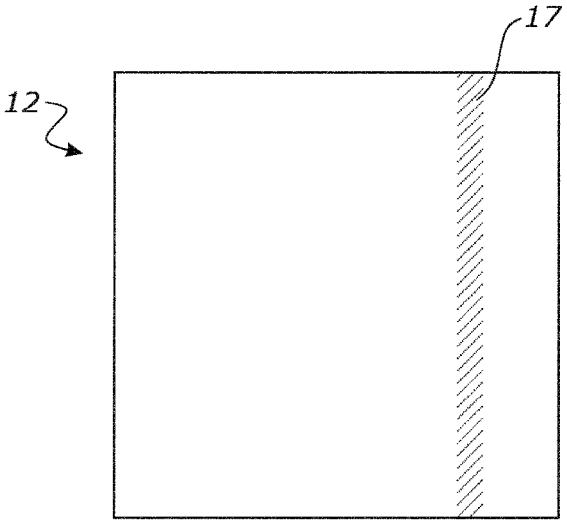
FIGS. 2A and 2B show views of a panel.

Shown in FIG. 2A is a top view of an exemplary embodiment of a first closure panel 12. The first closure panel 12 of FIG. 2A comprises a heat-sealable material on at least one of its major faces. The first closure panel 12 further comprises a strip 17 of material which does not bond under an application of heat and pressure. For example, where the application of heat and pressure comprises a heat sealing, the strip 17 comprises a non-heat-sealable material. The strip 17 may be a surface addition to the first closure panel 12, such as is shown the side view of FIG. 2B. Alternatively, as will subsequently be described, the strip 17 may be integral with the surface of the first closure panel 12, such as by being a replacement of a portion of an outer ply of a laminate first closure panel 12. In a preferred embodiment, if the portion of the outer ply 3 of the laminate first closure panel 12 is not replaced by a strip 17, the exposed portion of the second ply 4 can itself provide the characteristic of the non-bonding zone 15. This is because the second ply 4 may be of a non heat-sealable material.

Figure 2B:
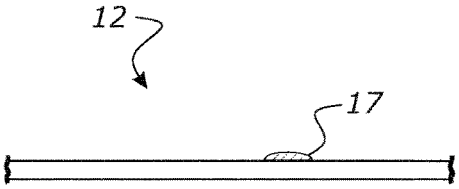

The strip 17 of the first closure panel 12 of FIG. 2B operates in conjunction with the back panel 7 to provide the non-bonding zone 15.

Figure 3A:
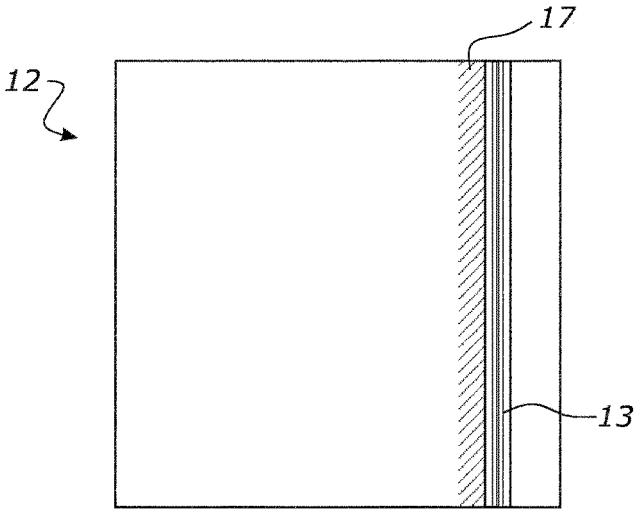
FIGS. 3A and 3B show views of a panel comprising a closure member.
Figure 3B:
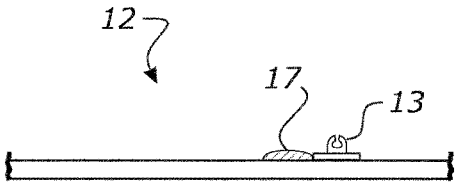

As previously described, the strip 17 may be provided as an integral part of the first closure panel 12 or may be provide as a surface addition to the first closure panel 12. For the purposes of illustration, the strip 17 is shown in FIGS. 2B to 4E as a surface addition to the first closure panel 12. As seen in FIG. 3B, a closure element 13 is provided on the first closure panel 12. While shown as located directly adjacent the strip 17, the closure element 13 and strip 17 may be separated from each other. However in primary embodiments of the invention, an adjacent, or nearly adjacent, configuration may be preferred in order to increase the usable volume of the containment region 10 of the bag.

Figure 4A:
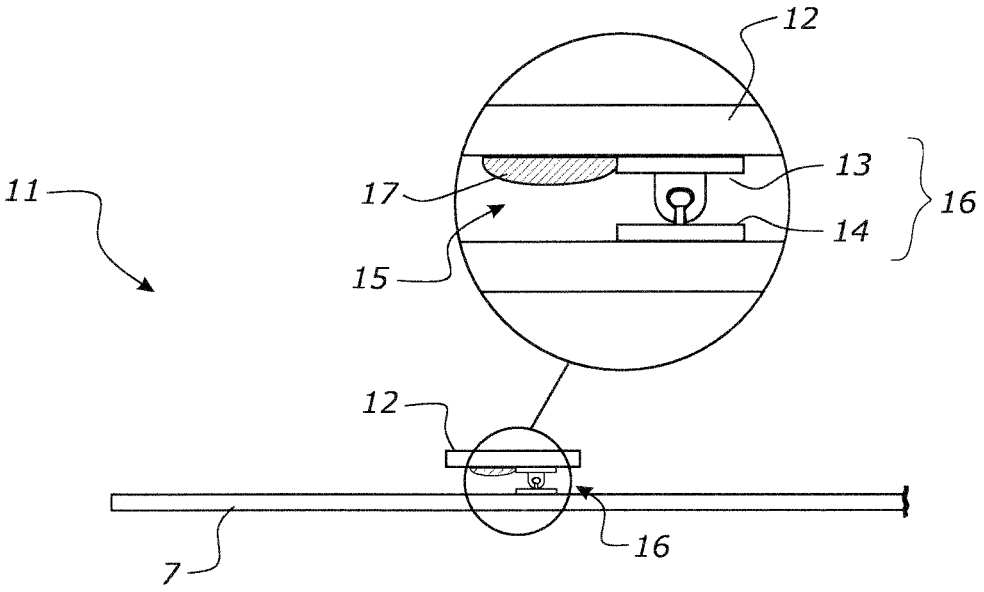
FIGS. 4A to 4E show various stages of an assembly and use of a bag.

FIG. 4A shows a cross-section of the back panel 7 and first closure panel 12 of the bag, and an exploded view of the detail of the first closure panel 12 and closure elements 13 and 14. As seen in FIG. 4A, the first closure panel 12 is associated with the back panel 7. This association may be by the connection of the closure element 13 of the closure element 14, and may additionally or alternatively be by a bonding of the first closure panel 12 to the back panel 7 at the sealing of the back panel 7 to the sides 8.

The non-bonding zone 15 is provided more proximate to the opening region 11, or more distal the base 9, than the closure elements 13 and 14 of the openable and re-closeable closure 16. The non-bonding zone 15 comprises the strip 17 of material which does not bond under an application of heat and pressure.

Figure 4B:
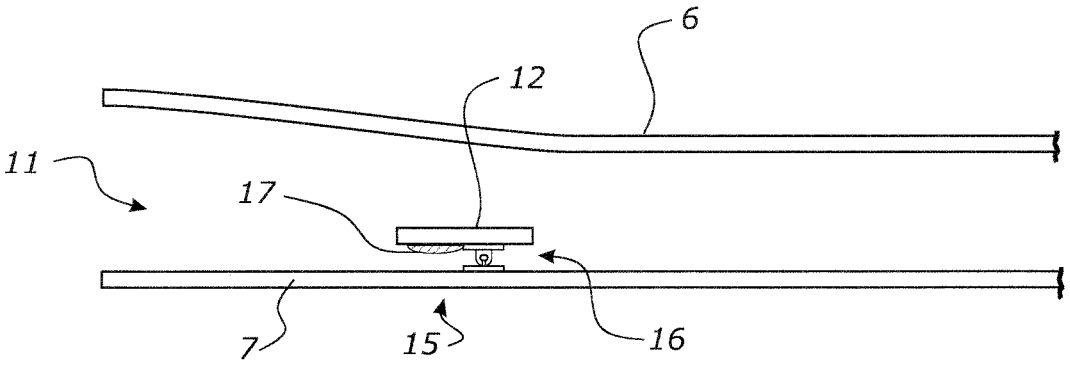

FIG. 4*b* shows a cross-section through a bag comprising the back panel 7 and first closure panel 12 of FIG. 4*a*, which is joined to the two sides 8, not shown, and a front panel 6. In the configuration of FIG. 4*b*, the first mode opening of the bag may be provided at the opening region 11 and between the front panel 6 and back panel 7. The first mode opening passes around rather than through the openable and re-closeable closure 16.

Figure 4C:
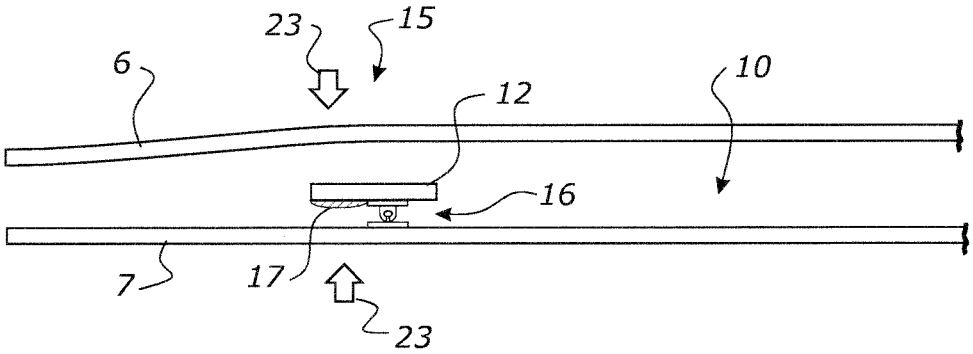

To affect the bag to its second mode, heat and pressure is applied along the non-bonding zone 15 as indicated by the arrows 23 of FIG. 4C.

Figure 4D:
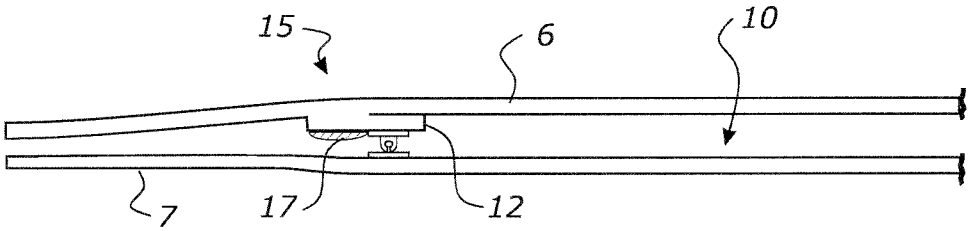

The resulting second mode configuration of the bag of FIG. 4C is shown in FIG. 4D. The first closure panel 12 has been bonded to the remainder 22 of the multi-panel assembly, including the front panel 6. But the first closure panel 12 and back panel 7 are prevented from bonding, and have not bonded to each other, at the non-bonding zone 15.

Figure 4E:
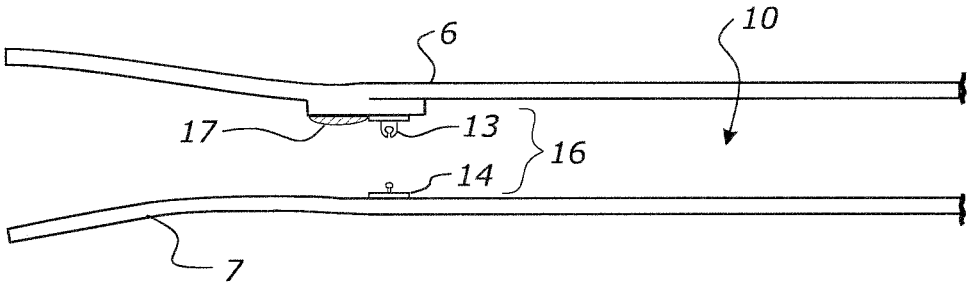

As a result, the second mode opening is able to be defined by the closure elements 13 and 14 of the openable and re-closeable closure 16, as shown in FIG. 4E.

As has been described, it may be desirable in some embodiments or for some applications of the bag 1 to provide a header. FIGS. 5A to 5H show a modification of the embodiment of FIGS. 4*a* to 4*e* to provide for a header 19 of the bag 1.

Figure 5A:
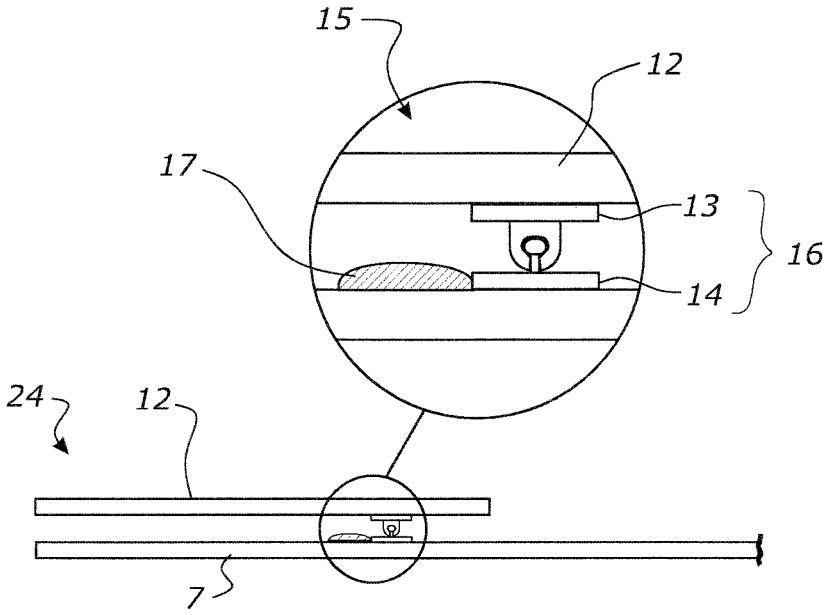
FIG. 5A to 5H show various stages of an assembly and use of a bag.

FIG. 5*a* shows an assembly of a first closure assembly 12 with a back panel 7, similar as seen in FIG. 4*a*. However, in FIG. 5*a*, the first closure panel comprises an extension distal the base region of the non-bonding zone 15. This area will now be referred to as the header zone 24. While not necessary for the formation of a header 19, the embodiment of FIG. 5*a* also varies from the configuration of FIG. 4*a* in that the strip 17 is shown provided as part of the back panel 7 rather than the first closure panel 12.

Figure 5B:
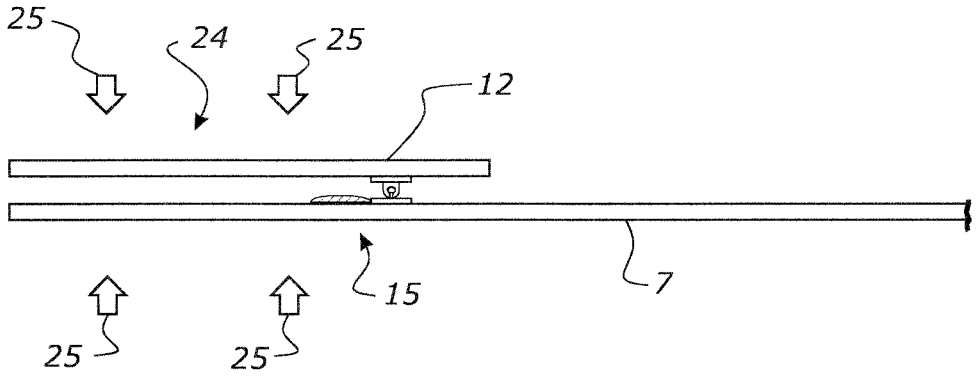
Figure 5C:
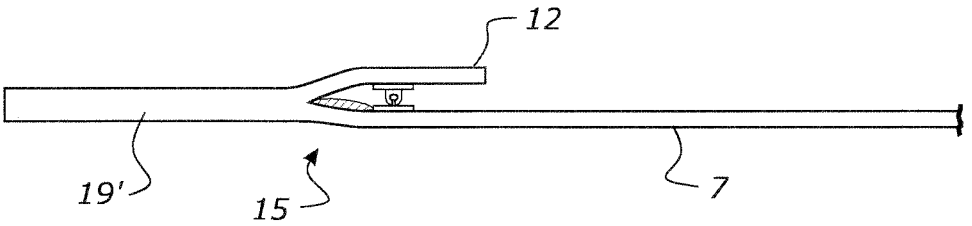

The first part of the header 19 may be formed as shown in FIGS. 5*b* and 5*c*, prior to the joining of the back panel 7 and first closure panel 12 with the sides 8 to form the bag 1. As seen in FIG. 5*b* the first closure panel 12 and back panel 7 are bonded together by an application of heat and pressure at the header zone 24 and in the direction of the arrows 25.

This bonds the back panel 7 and first closure panel 12 together to form a partial header 19' at the header region 24.

While shown as extending the whole way to the top of the first closure panel 12 and back panel 7, bonding at the header region 24 may not extend this far, but rather only as far as required to form a sealed header.

Figure 5D:
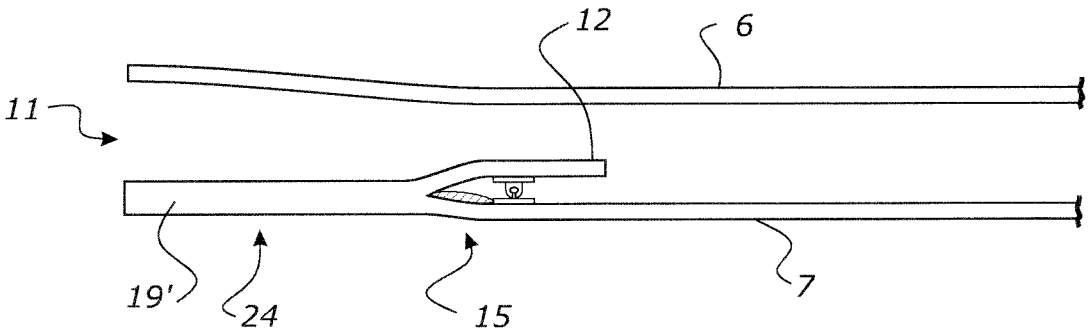
Figure 5E:
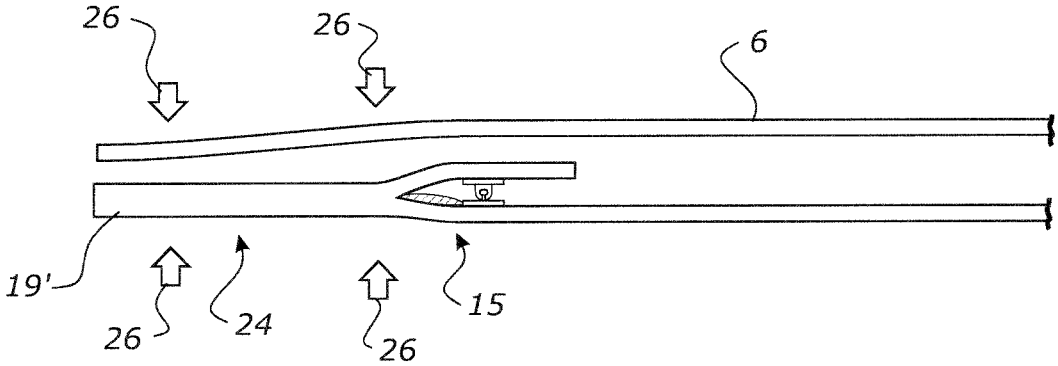

FIG. 5*d* shows a cross-section of the assembly of FIG. 5*c* when associated with the sides 8 and front panel 6 of the bag. As shown in FIG. 5*d* the first mode opening is able to be defined between the front panel 6, back panel 7 and the sides 8 of the bag. At the opening region 11 the back panel 7 is provided as the partial header 19'.

To affect the bag 1 of FIG. 5*d* into its second mode, the bag is subjected to an application of heat and pressure at the non-bonding zone 15, as has been described in relation to FIGS. 4*c* and 4*d*. However, to form the header 19 the front panel 6 and partial header 19' are also bonded together at the header region 24 as shown by the arrows 26. In the preferred form this bonding of the front panel to the partial header 19' is provided by an application of heat and pressure at the non-bonding zone 15. However, any other form of bonding may be provided to form the header 19.

Figure 5F:
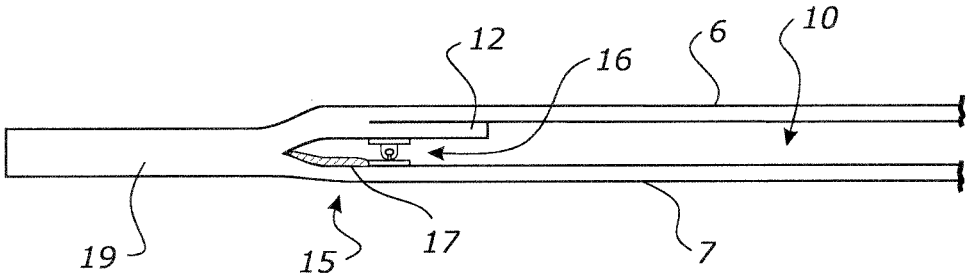

FIG. 5*f* shows a cross-section through the bag showing the full header 19 of the bag. The first closure panel 12 and front panel 6 have been bonded together at the non-bonding zone 15, but the first closure panel 12 and back panel 7 have not been bonded together at the non-bonding zone 15.

In order to access the second mode open of the bag the header 19 must be removed or one side of it cut into at the non-bonding zone 15. By cutting or tearing the bag 1 through the non-bonding zone 15 the header 19 may be removed and the second mode opening of the bag exposed. This is seen in FIGS. 5*g* and 5*h*.

Figure 5G:
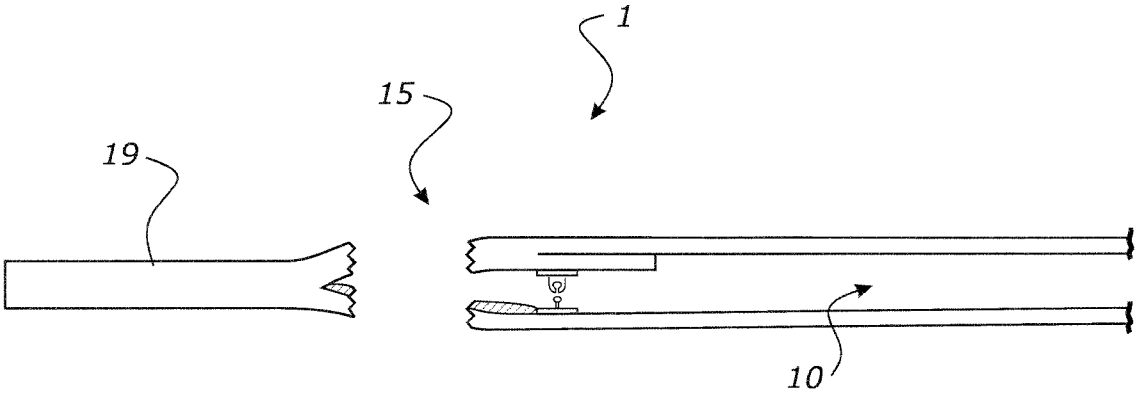
Figure 5H:
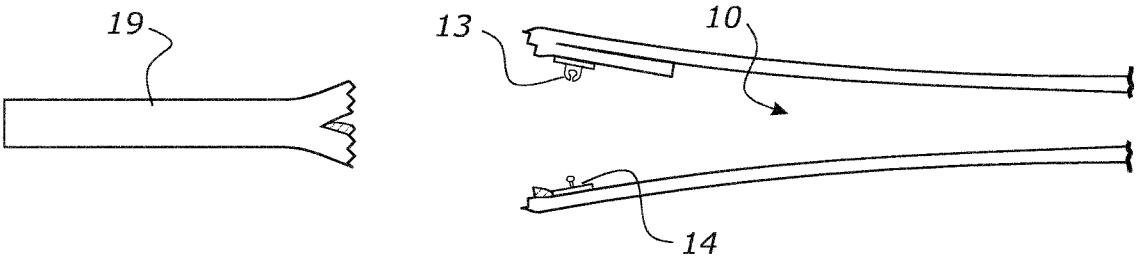

FIG. 5*h* shows the cross-section of the bag of FIG. 5*g* open at the second mode opening between the closure elements 13 and 14 of the openable and re-closeable closure 16.

Figure 6:
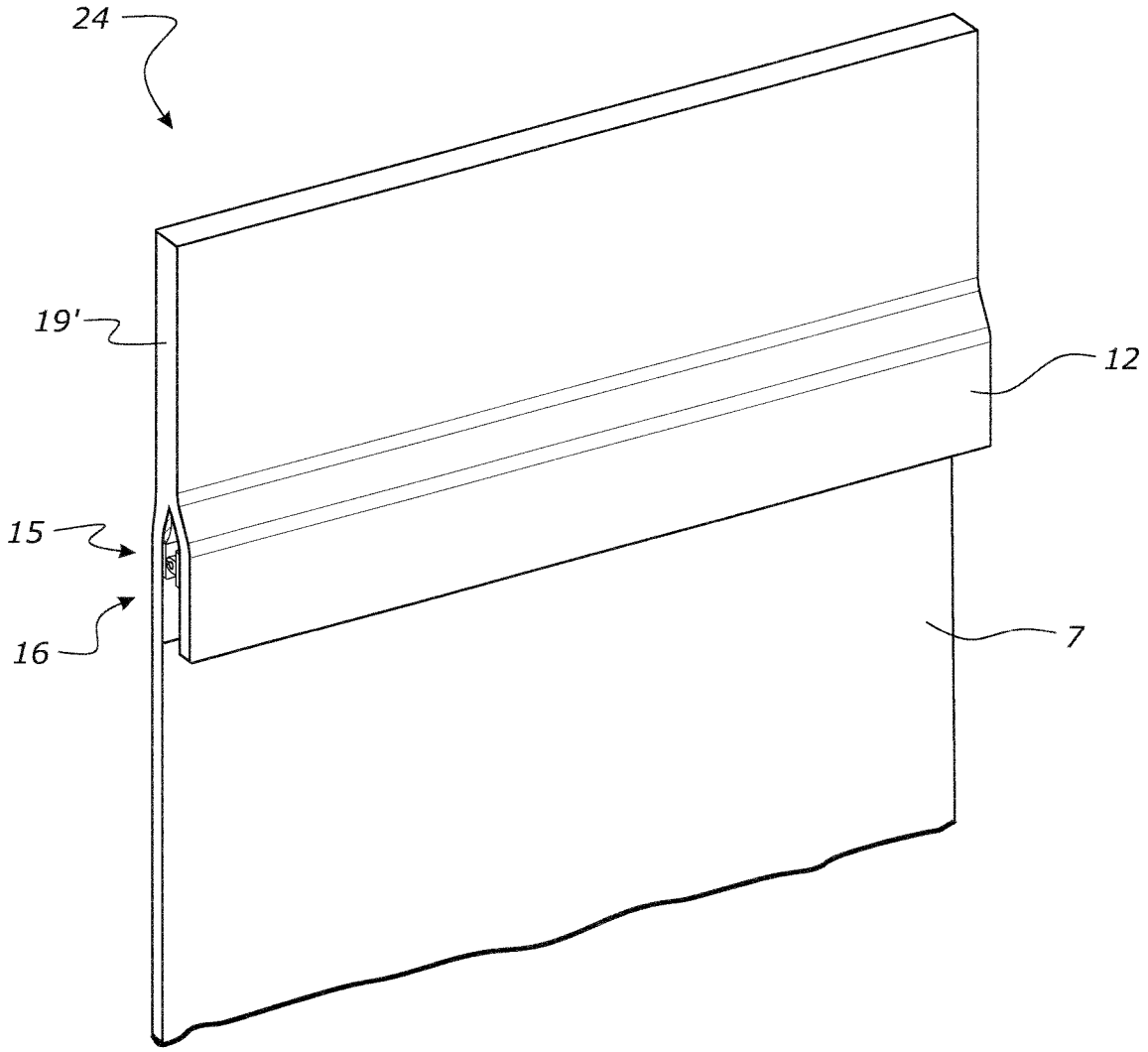
FIG. 6 shows a view of a panel and closure assembly.

FIG. 6 shows a perspective view of a back panel 7 assembled with a first closure panel 12 to form a partial header 19' such as also shown in FIG. 5*c*. The assembly of a bag in order to form the partial header 19' may be desirable in order to protect the closure elements 13 and 14 of the openable and re-closeable closure during the filling of the bag with its contents. Because of the partial header 19', items passed into the bag during filling are not able to fall onto the openable and re-closeable closure 16, or become lodged in or between the closure elements 13 and 14.

Figure 12A:
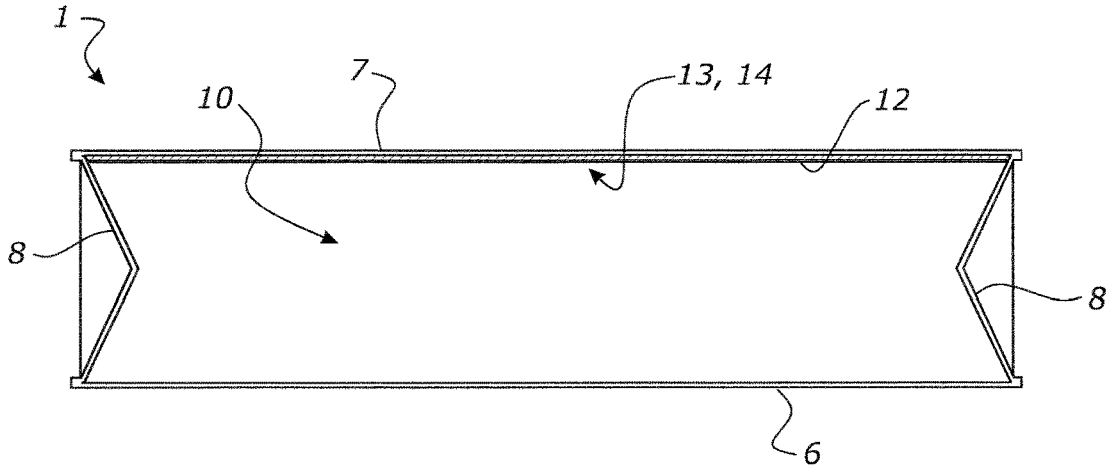
FIG. 12A shows a top-down view of a bag with a first mode opening.

FIGS. 12*a* to 12*d* show a top down view of the opening region 11 of a bag 1 between the first mode and second mode. FIG. 12*a* shows the bag 1 in its first mode. The first closure panel 12 is associated with the back panel 7. The perimeter of the first mode opening is defined by the back panel 7 with the first closure panel 12, the sides 8 and the front panel 6.

Figure 12B:
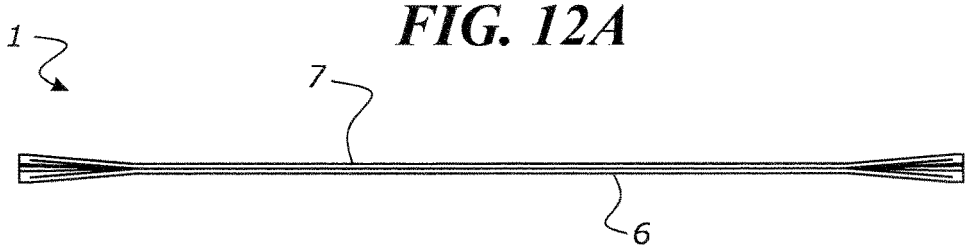
FIG. 12B shows the bag of FIG. 12A flattened on itself.

FIG. 12*b* shows the bag 1 flattened at the gusseted sides 8 for the application of heat and pressure along the non-bonding zone 15. One half of each gusseted side 8 is adjacent the back panel 7 and front panel 6.

Figure 12C:
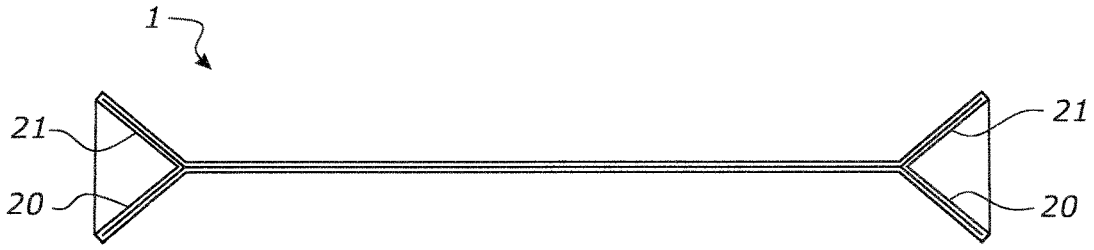
FIG. 12C shows the bag of FIG. 12A or 12B subsequent to an application of heat and pressure.

FIG. 12*c* shows the bag 1 of FIG. 12*b* subsequent to the application of heat and pressure at least along the non-bonding zone 15. As seen in FIG. 12*c* the closure elements 13 and 14 of the openable and re-closeable closure 16 are either still associated with each other, and/or a header 19 of the bag has also been formed as previously described.

FIG. 12*c* shows a preferred form wherein the outside facing portions of the gusseted sides 8 are not bonded to each other during the application of heat and pressure along the non-bonding zone 15. This results in the gusseted sides 8 forming wing portions 20 and 21 at either side of the bag.

Figure 12D:
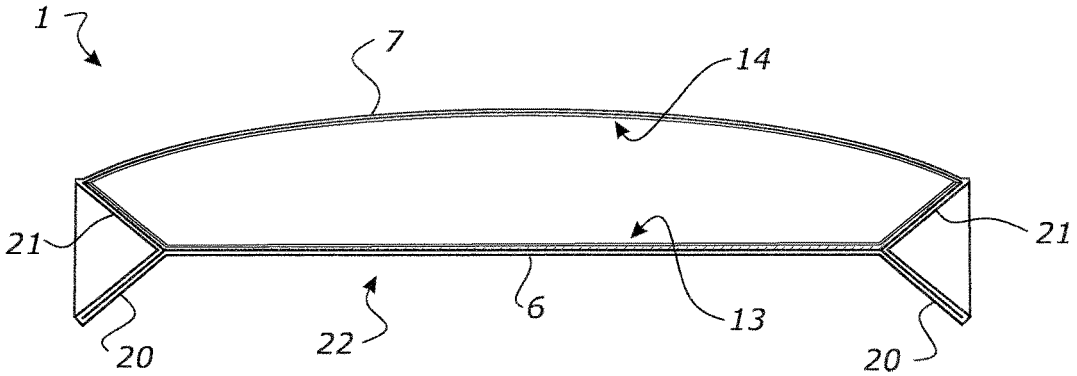
FIG. 12D shows a top down view of a bag with a second mode opening.

FIG. 12*d* shows the second mode opening of the bag 1. In this configuration the closure elements 13 and 14 have been separated from each other, and any header 19 has been removed from the bag. The perimeter of the second mode opening is shown as being defined by the two closure elements 13 and 14. FIG. 12*d* also clearly illustrates the remainder 22 of multi-panel assembly to which the first closure panel 12 is bonded. The remainder 22 comprises the second wing portions 21 of each gusseted side 8 and the portion therebetween of the front panel 6.

Figure 13A:
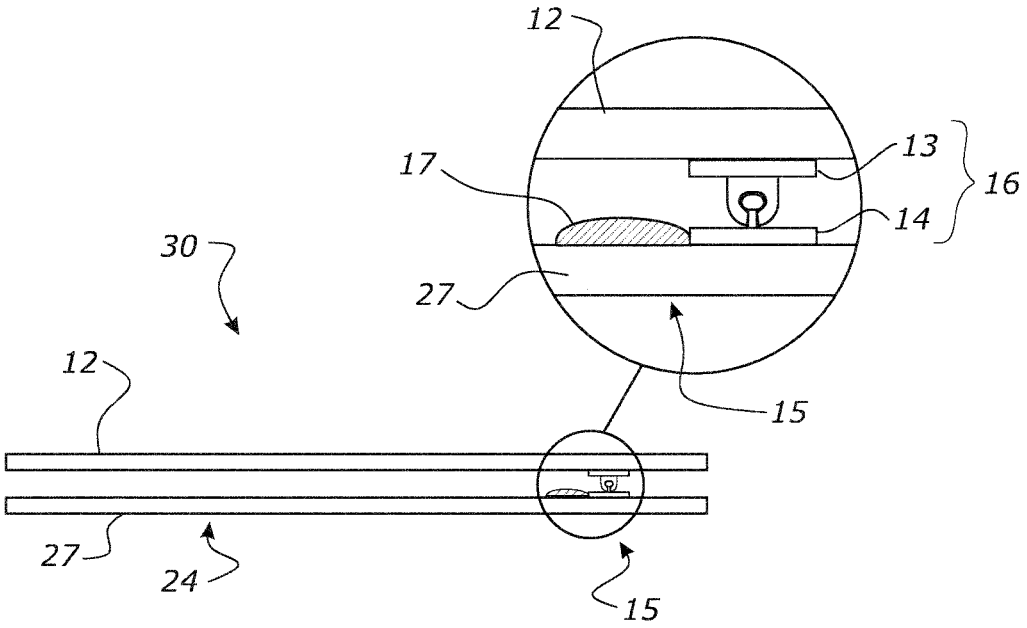
FIG. 13A shows a view of a closure subassembly.

In a preferred embodiment the closure elements 13 and 14 may be provided as part of a closure subassembly 30. Such a closure subassembly 30 is shown in FIG. 13*a*. The closure subassembly 30 preferably comprises the first closure panel 12 and a second closure panel 27.

The closure element 13 is for association with the first closure panel 12, and the closure element 14 is for association with the second closure panel 27. As previously described, the first closure panel 12 and second closure panel 27 may comprise a non-bonding zone 15 at which the first closure panel and second closure panel are prevented from bonding to each other under an application of heat and pressure. The prevention from bonding in FIG. 13*a* may be provided by the strip 17 of material which does not bond under an application of heat and pressure.

The strip 17 is shown in FIG. 13*a* as associated with the second closure panel 27, but may alternatively be associated with the first closure panel 12, or with each of the first closure panel 12 and second closure panel 27.

The prevention at the non-bonding zone may additionally comprise any of the other preventions herein described, and the strip or strips 17 may be provided as an addition to or integral with either or both of the first closure panel 12 and second closure panel 27.

It may be desirable to provide a closure subassembly 30 in order to simplify the manufacture of a bag according to the invention. The closure subassembly 30 may be provided for bonding to a back panel 7 in the form shown in FIG. 13*a*. Alternatively, the first closure panel 12 and second closure panel 27 of the closure subassembly 30 may be bonded together at the header zone 24 of the closure subassembly 30 prior to the bonding of the closure subassembly to the back panel 7.

Figure 13B:
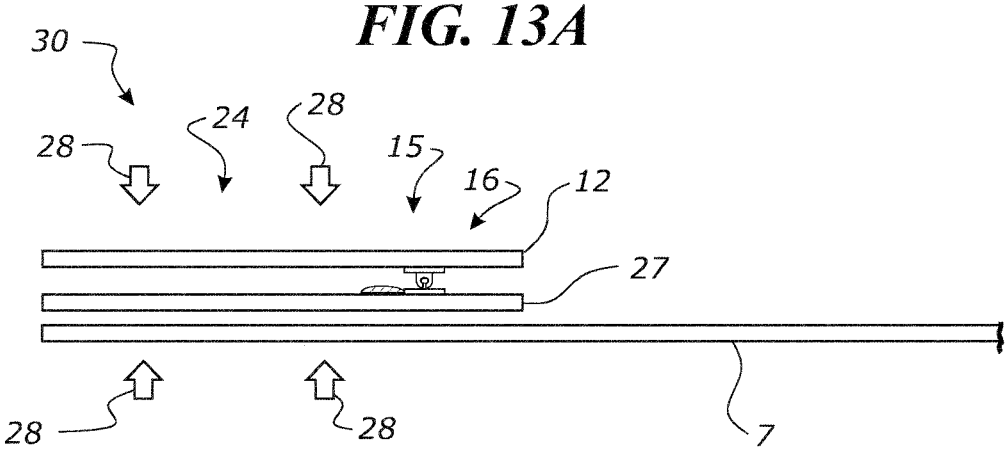
FIGS. 13B and 13C show stages of a bonding of the closure subassembly of FIG. 13A to another panel.

FIG. 13*b* shows the association of a closure subassembly 30 with the back panel 7 of a bag. Heat and pressure is to be applied to the closure subassembly 30 and the back panel 7 at least at the non-bonding zone 15 to bond the second closure panel 27 to the back panel 7. As shown in FIG. 13*b*, the closure subassembly 30 may also be bonded to the back panel 7 at the header region 24, as indicated by the arrows 28.

Figure 13C:
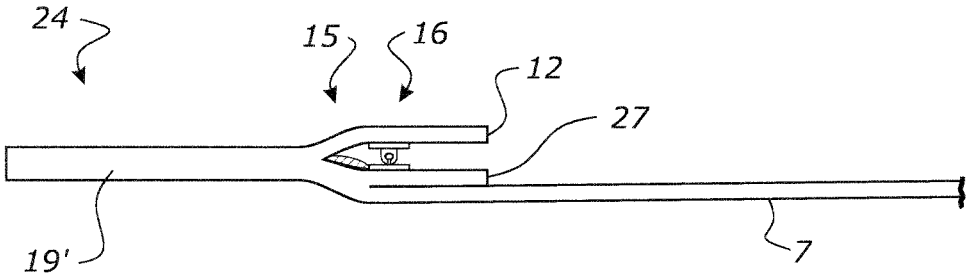

FIG. 13*c* shows a cross-section of the back panel 7 of a bag which has been bonded with a closure subassembly 30. The second closure panel 27 is bonded to the back panel 7 at the non-bonding zone 15. The closure subassembly 30 comprising the first closure panel 12 and second closure panel 27 is also bonded to the back panel 7 to form a partial header 19'.

Figure 13D:
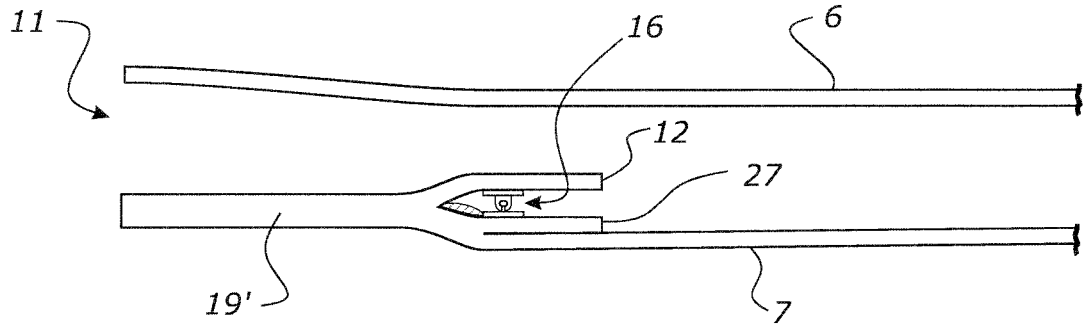
FIG. 13D shows the assembly of FIG. 13C as part of a bag with a first mode opening.

The back panel 7 of FIG. 13*c* may then be joined with the sides 8 and front panel 6. A cross-section through the resulting bag assembly is shown in FIG. 13*d*. In the configuration of FIG. 13*d* the first mode opening of the bag is shown at the opening region 11 and past the openable and re-closeable closure 16. A previously described, the bag may then be filled through the first mode opening with its desired contents.

Figure 13E:
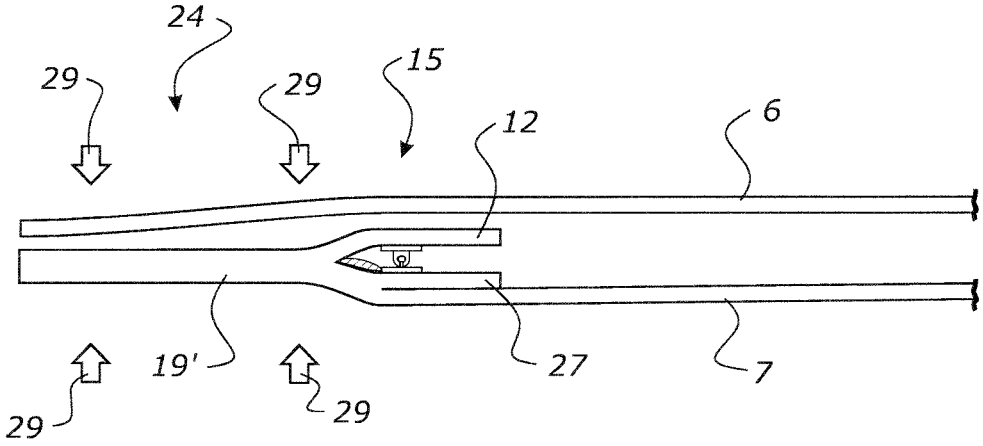
FIGS. 13E and 13F show stages of a bonding of the bag of FIG. 13D.

Preferably, once filled, the bag can then be converted to its second mode. The cross-section of FIG. 13*e* shows the bonding of the combined back panel 7 and closure subassembly 30 to the remainder 22 of the multi-panel assembly and particularly to the front panel 6. Heat and pressure is to be applied at least at the non-bonding zone 15, to bond the first closure panel 12 to the front panel 6. The partial header 19' may also be bonded to the front panel 6 at the header zone 24 to form a header 19 of the bag.

Figure 13F:
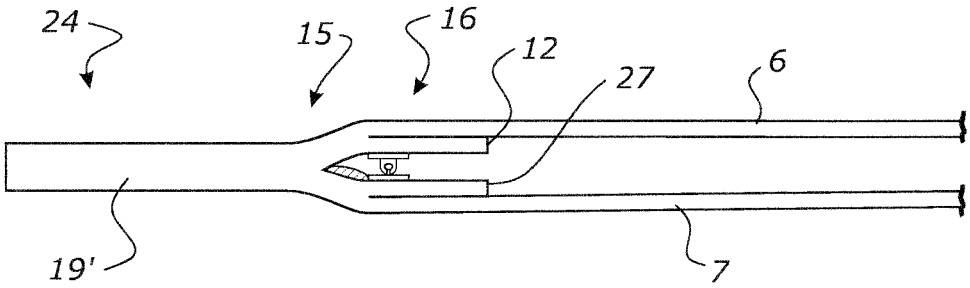

The resulting bag following the application of heat and pressure along the non-bonding zone and the bonding of the partial header 19' and front panel 6 at the header zone 24 is shown in FIG. 13*f*. Also shown in FIG. 13*f* is the bonding of the first closure panel 12 to the front panel 6 at the non-bonding zone 15, and the bonding of the second closure panel 27 to the back panel 7 at the non-bonding zone 15.

Figure 13G:
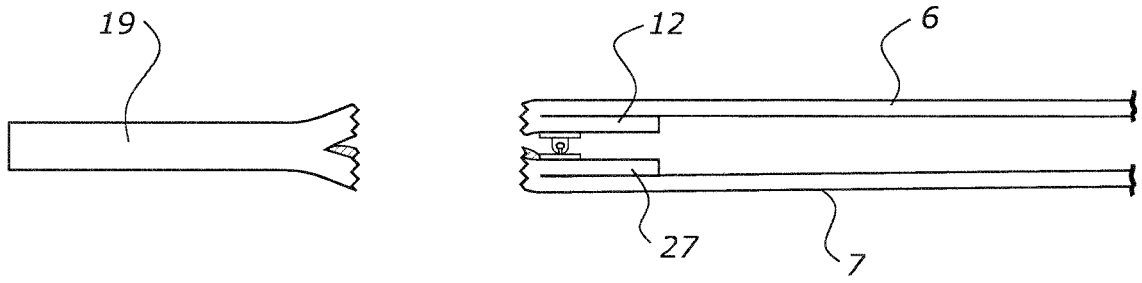
FIG. 13G shows the bag of FIG. 13F with a header of the bag removed.

As previously described, the header 19 may then be removed by a cutting or tearing of the bag along the non-bonding zone 15. Shown in FIG. 13*g*, the header 19 has been separated from the remainder of the bag at the non-bonding zone 15. This exposes the second mode opening which is able to be defined between the closure element 13 of the first closure panel 12 and the closure element 14 of the second closure panel 27, as shown in FIG. 13*h*.

Figure 13H:
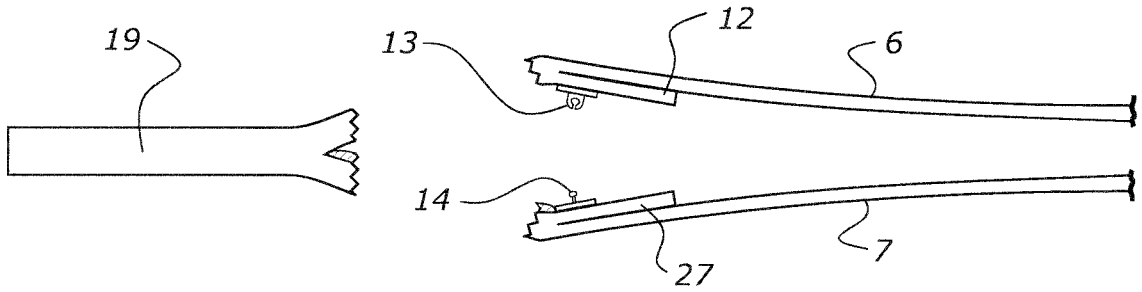
FIG. 13H shows the bag of FIG. 13G with a second mode opening of the bag between two closure elements.

Bonding of each closure panel 12 and 27 to, respectively, the front panel 6 and back panel 7 at the non-bonding zone 15 allows for the second mode opening to be created and for the transfer of the closure element 13 and closure panel 12 from their initial association with the back panel 7 to their second mode association with the remainder 22 of the multi-panel assembly, and as shown in FIG. 13*h*.

In a preferred embodiment, the width of each of the first closure panel 12 and the second closure panel towards the base 9 of the bag can just reach the lower edge of the closure elements 13 and 14 (i.e. the edge closer to the base 9), rather than going beyond the said lower edges as shown in for example FIG. 13A.

Figure 14A:
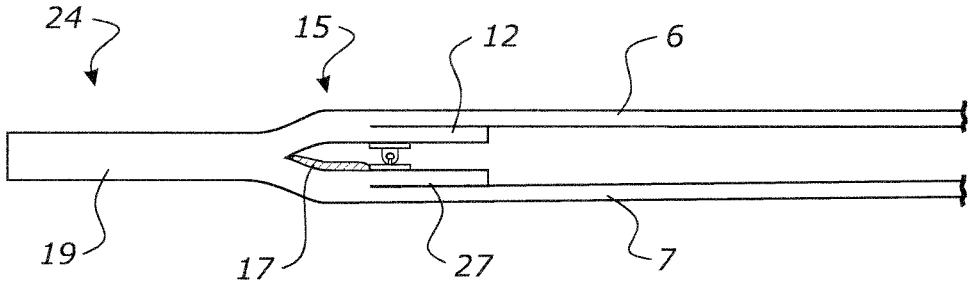
FIGS. 14A and 14B show a further embodiment of the bag shown in FIGS. 13F and 13G.
Figure 14B:
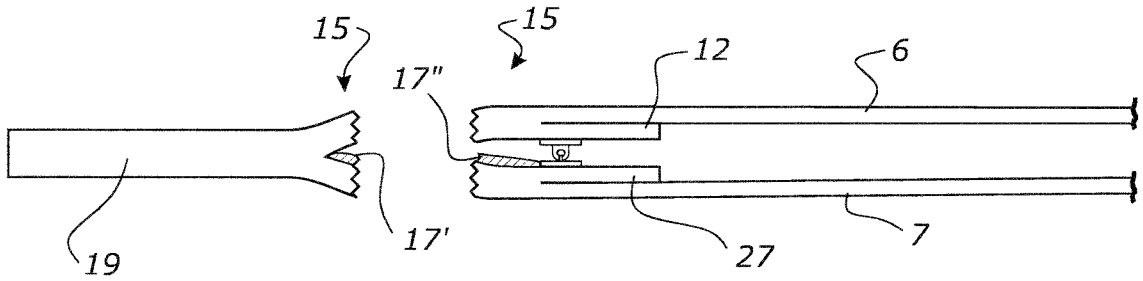

In order to help ensure the secure association of each closure panel 12 and 27 with the respective remainder 22 and back panel 12 of the multi-panel assembly of the bag in the second mode it may be desirable to control the size of the non-bonding zone 15. For example, as shown in FIGS. 14*a* and 14*b*, the non-bonding zone 15 is wider than shown in relation to previous embodiments.

By the provision of a wider non-bonding zone 15, the first closure panel 12 may be associated with the front panel 6 and the second closure panel 27 may be associated with the back panel 7, over a larger area. This may assist in ensuring the connection of these parts to each other, and potentially providing increased durability to the bag. For example, the bag may be able to undergo an increased number of cycles of opening and closing of the openable and re-closeable closure 16 over its lifetime before failure of the bond between the closure panels and the front and back panels.

A wider non-bonding zone may also make it simpler for a provider who closes the bag after its filling to apply heat and pressure at the header zone 24. This is because a wider non-bonding zone 15 may provide a greater margin of error for the bonding of the header zone 24 without also bonding the closures to each other, meaning that less precision is required in applying the heat and pressure.

If the bag is to be cut or torn at the non-bonding zone 15 to remove a header 19, the location of the cut or tear is preferably more distal the base than the openable and re-closable-closure 16, in order to ensure that each closure panel 12 and 27 remains attached to the remainder 22 and back panel 7 respectively of the bag.

Figure 15:
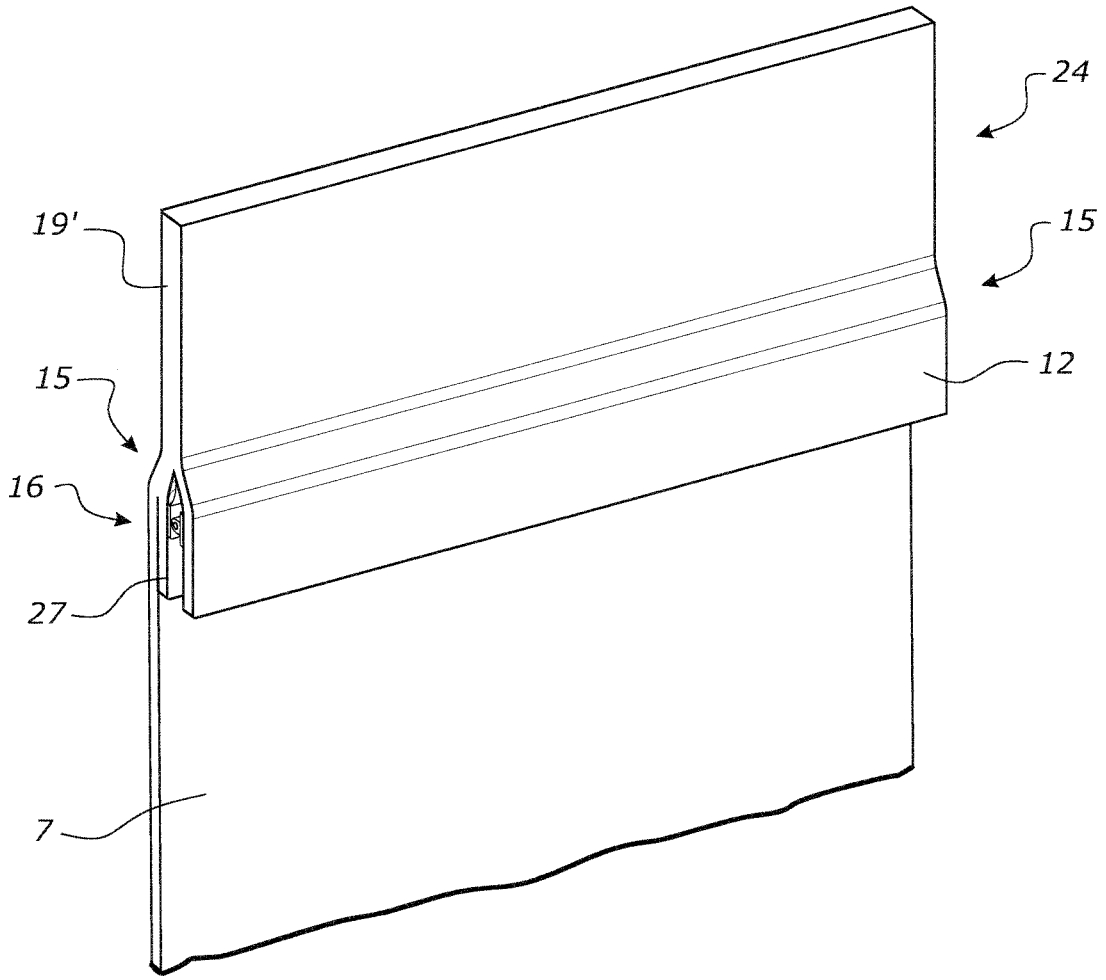
FIG. 15 shows a view of a panel and a closure assembly.

FIG. 15 shows a back panel 7 comprising a closure subassembly 30, such as has been shown and described in relation to FIG. 13*c*. In FIG. 15 the first closure panel 12 and second closure panel 27 of the closure subassembly 30 are shown bonded to the back panel 7 to form a partial header 19'. The second closure panel 27 is additionally bonded to the back panel 7 at the non-bonding zone 15.

Figure 16:
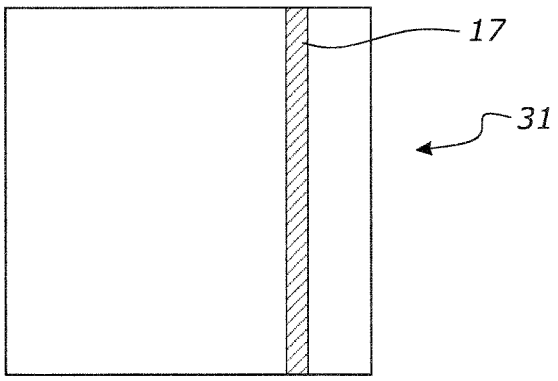
FIG. 16 shows a view of a panel.

FIG. 16 shows a panel 31. The panel 31 may be variously one or more of the back panel 7, first closure panel 12, second closure panel 27, or the sides 8.

The panel 31 comprises a strip 17 of material which does not bond to another material under an application of heat and pressure, such as a heat sealing. In the preferred form the components of the bag of the invention which are to be bonded to each other, or at least the outer laminates or films of such components, comprise a heat sealable material. Thermoplastics, such as polyethylene or polypropylene, are heat sealable. Such heat sealable materials bond to each other under an application of heat and pressure, such as a heat sealing.

Where components of the bag are to not bond together and to be prevented from bonding together, at least one of the materials preferably comprises a non-thermoplastic material. For example, as seen in FIG. 16, a strip 17 of a non-thermoplastic material is provided to facilitate the non-bonding zone 15. While shown for illustrative purposes as having a different surface appearance, the strip 17 may substantially correspond in appearance with the surrounding material of the panel 31.

Figure 17A:
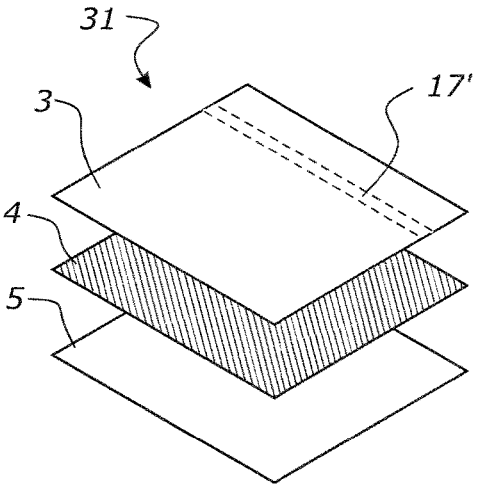
FIG. 17A shows a laminate configuration of a panel.
Figure 17B:
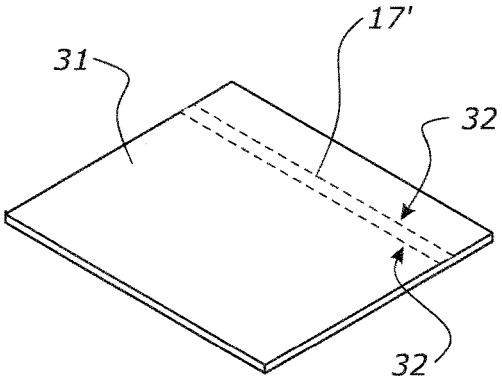
FIG. 17B shows the laminated panel of FIG. 17A.

Shown in FIGS. 17*a* and 17*b* is a panel 31. The panel 31 comprises three plies. A first ply 3 and third ply 5 are preferably of a thermoplastic material which bonds to another thermoplastic material under a heat sealing. The second ply 4, which is preferably provided between the first ply 3 and third ply 5, may comprise a material with desirable stiffness or resilience characteristics. For example, it may be less elastic than either the first ply 3 or second ply 5. The three plies 3, 4, and 5 are laminated together to provide the panel 31. The first ply 3 being one of the outer plies of the panel, comprises the strip 17 of non-thermoplastic material. While previously shown as comprising a material addition to a surface of panel, such as in FIG. 2*b*, the strip 17 may comprise a replacement of the outer ply 3 of the panel 31. This is shown in FIGS. 18*a* to 19*b*.

As mentioned above, in a preferred embodiment, if the portion of the outer ply 3 of the laminate first closure panel 12 is not replaced by a strip 17, the exposed portion of the second ply 4 can itself become the non-bonding zone 15. This is because the second ply 4 may be of a non heat-sealable material.

Figure 18A:
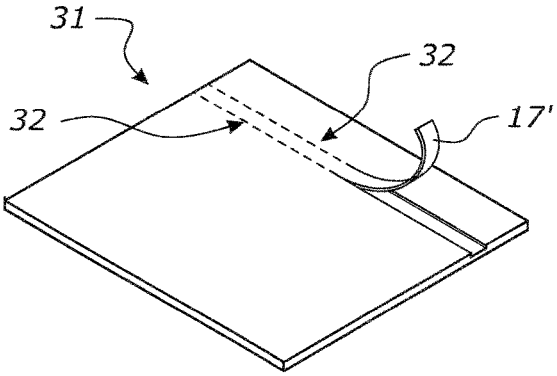
FIG. 18A shows the removal of a portion of a ply of a laminated panel.
Figure 18B:
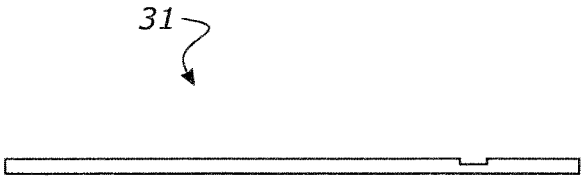
FIG. 18B shows a view of the panel of FIG. 18A having the portion removed.
Figure 19A:
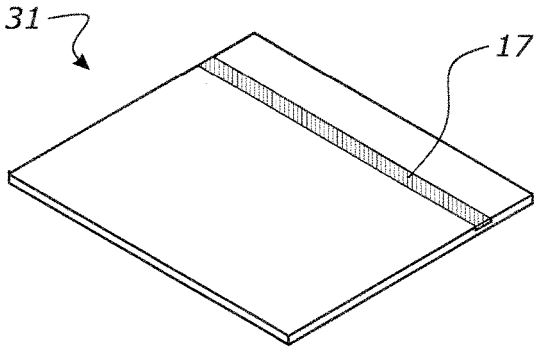
FIGS. 19A and 19B show views of the panel of FIG. 18B where a portion of a ply has been replaced with another portion.
Figure 19B:
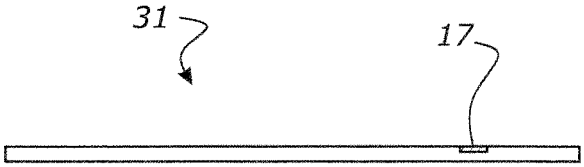

Thus the embodiment shown in FIG. 18B may be a more preferred configuration than that shown in FIG. 19B, as some cost and manufacturing time can be reduced by not replacing the removed portion of the outer ply 3 by a strip 17 of non-thermoplastic material.

Seen in FIG. 18*a*, the portion of the outer ply 3 of the laminate panel 31 may be removed along the strip 17'. The strip 17' may be cut or excised from the surface of the panel 31, or there may be existing lines of weakness 32 of the first ply 3 to facilitate the removal of the strip 17'. FIG. 18*b* shows a side view of panel 31 of FIG. 18*a*, wherein the strip 17' has been removed.

Shown in FIGS. 19*a* and 19*b*, the gap left by the removal of the strip 17' has been filled by the insertion of a strip 17.

The strip 17 preferably comprises a non-thermoplastic material, which does not bond to another thermoplastic under heat sealing. The strip 17 may be bonded by any suitable means to the panel 31.

It may be desirable to provide for a line or lines of weakness at various locations in the panels of the bag 1. For example, such lines of weakness may facilitate with the tearing or otherwise removal of the header 19 of the bag, if one exists. Such a line of weakness may be introduced by perforation, or partial tearing of the panel at the desired location. However, a preferred form of introducing a line of weakness will now be described.

Figure 20:
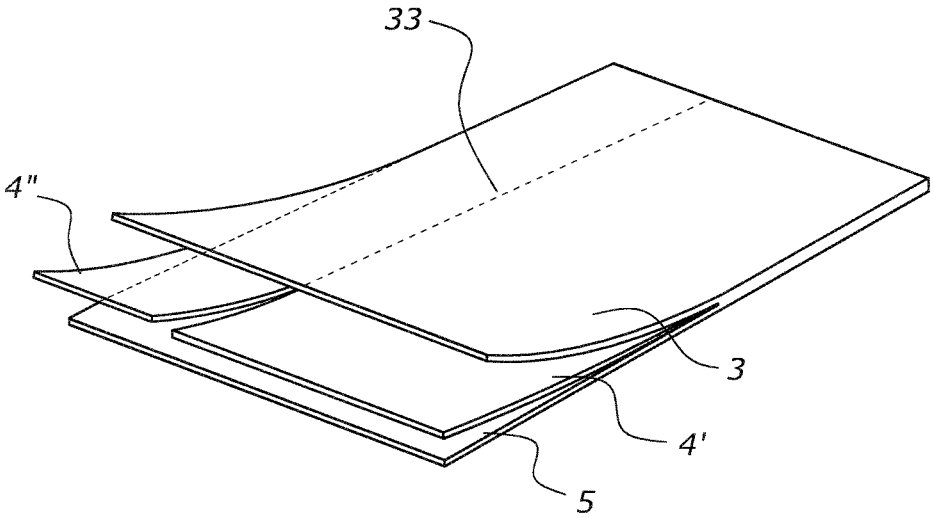
FIG. 20 shows a panel configuration to introduce a line of weakness.

FIG. 20 shows an example panel 31 according to the invention having a line of weakness 33. The panel 31 comprises a plurality of plies, such as a first ply 3, second ply 4 and third ply 5. The second ply 4 is sandwiched between the first ply 3 and third ply 5. At the location of the desired line of weakness 33, the second ply 4 comprises two unconnected pieces with substantially abutting adjacent edges. These abutting adjacent edges of the first piece 4' and second piece 4" of the second ply 4 act to define the line of weakness 33.

Such a configuration may be particularly effective in providing for a line of weakness of a panel 31 wherein the second ply 4 provides a substantial portion of the resilience of the entire panel 31. The line of weakness 33 of a laminated panel 31 may be visible, or may be substantially occluded.

Figure 21:
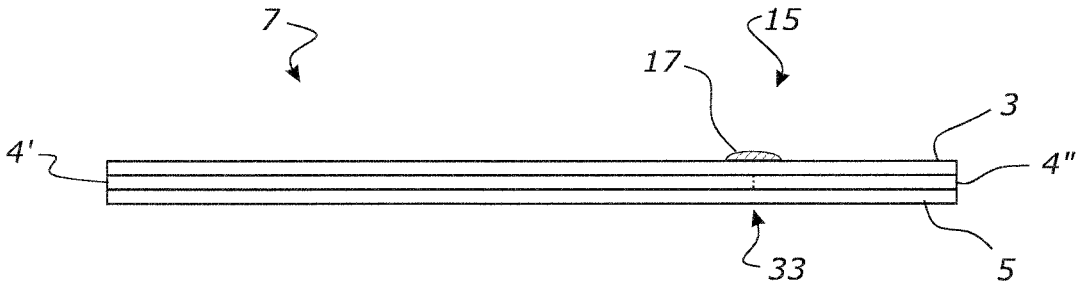
FIG. 21 shows a laminate panel having a line of weakness and a surface addition.

In a bag 1 it may be desirable to provide one or more lines of weakness of one or more panels of the bag at the non-bonding zone 15, particularly for the removal of a header 17. For example, FIG. 21 shows a back panel 7 according to the bag 1 of the embodiment of FIGS. 4*a* to 4*e*. The back panel 7 comprises a laminate of a first ply 3, second ply 4 and third ply 5. The second ply 4 comprises a first portion 4' and a second portion 4", with their abutting edges running along the non-bonding zone 15 beneath the strip 17.

Figure 22:
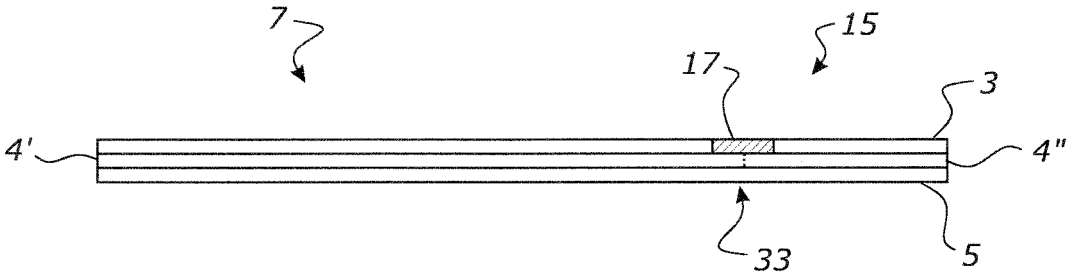
FIG. 22 shows a laminate panel having a line of weakness and a partial replacement of a laminate ply.

Similarly, FIG. 22 shows a back panel 7 having the same laminate configuration, wherein the first ply 3 has been replaced at the non-bonding zone 15 with a strip 17. The line of weakness 33 is also provided by the abutting edges of the first portion 4' and second portion 4" of the second ply 4.

While a back panel 7 of the embodiment of FIGS. 4*a* to 4*e* is shown in FIGS. 21 and 22 with a line of weakness 33, any one or all of the panels of the bag, particularly at the non-bonding zone 15, may comprise the minor weakness 33.

More than one panel at the non-bonding zone having a line of weakness 33, and those lines of weakness being substantially aligned to assist in the tearing of the bag such as to remove a header 19.

In a preferred embodiment, at least the outer ply 5 comprises a line of weakness. In a second preferred embodiment, each of the outer ply 5 and the second ply 4 comprises a corresponding line of weakness. The line of weakness can be created by the provision of adjacent unconnected plies as previously described. It may also be introduced by perforation of one or more plies, or by any other commonly available manner of introducing a line of weakness.

Where a line of weakness 33 is provided at the non-bonding zone for facilitating the removal of a header 17, it may be preferred to locate the line or lines of weakness 33 within the non-bonding zone 15 but distal of the openable and re-closable closure 16. This may ensure a maximum of the connection of a) the first closure panel 12 with the front panel 6, or b) the first closure panel 12 with the front panel 6 and the second closure panel 27 with the back panel 7, remains following the removal of the header.

As previously described, in a preferred form the outside facing portions of the side or sides 8 comprising a gusset formation are not bonded to each other during the transition to the second mode. This results in a bag having the wing portions 20 and 21. This configuration may be desirable such as to provide an increase in the internal volume of the bag.

Stopping the gusseted sides from bonding to each other during the transition to the second mode may be accomplished by the insertion of insulating material between them, or by the individual bonding of each wing portion 20 and 21 so that they are not bonded to each other. However, the prevention of bonding the outside of the gusset side 8 to itself may also be provided by the external face of the side 8 comprising a non-thermoplastic material, or at least one half of the gusseted side 8 comprising a non-thermoplastic material.

Figure 23:
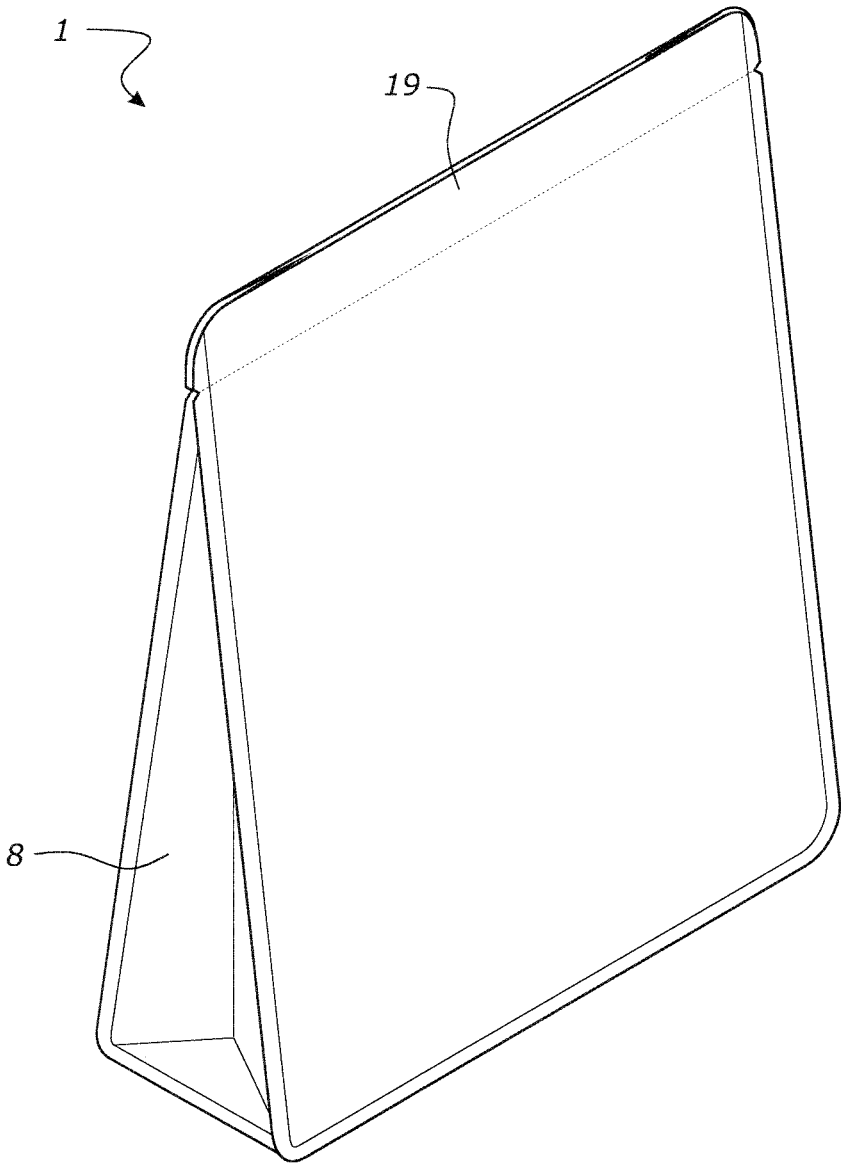
FIG. 23 shows a bag of a further embodiment.

An alternative configuration wherein the sides 8 comprising the gusset formation are bonded to each other during the transition to the second mode is shown in FIG. 23.

In an alternative embodiment, the closure elements 13 and 14 of the openable and re-closeable closure 16 are prevented from bonding to each other under an application of heat and pressure. For example, the closure elements 13 and 14 may comprise a non-thermoplastic material, such that they do not heat seal to each other. In this configuration, the application of heat and pressure along the non-bonding zone 15 in the transition to the second mode may extend into the region having the openable and re-closeable closure 16 without causing the closure elements 13 and 14 to bond to each other.

The difference in perimeter of the second mode opening and the first mode opening is preferably substantially equal to the length of the two sides 8. As the gusset formation of the side or sides 8 are bonded to the front panel 6 and back panel 7, the width of the sides may reflect the difference in perimeter between the first mode opening and the second mode opening.

The material of the strip 17 or any other part of the bag which is not bondable under an application of heat and pressure may be any commonly utilised non-thermoplastic material, such as but not limited to one or more of polyethylene terephthalate, nylon, or aluminium.

The bag 1 preferably comprises of components of a plastic material, and the application of heat and pressure therefore comprises a plastic welding. Plastic welding may be selected from any commonly available form of plastic welding such as but not limited to a contact welding, an infrared welding, an ultrasonic welding, a hot gas welding and a heat sealing. Heat sealing may be a preferred form of plastic welding.

Where components are able to be bonded to each other under an application of heat and pressure, they preferably have a heat sealable relationship. Conversely, where a component such as a ply or a panel of the multi-panel assembly is not bondable to another ply or panel of the multi-panel assembly under an application of heat and pressure the two parts have a non-heat sealable relationship.

A heat sealable relationship is preferably one of two thermoplastic materials to each other, while the non-heat sealable relationship is a relationship of a non-thermoplastic material to another thermoplastic or non-thermoplastic material. Such thermoplastic materials may comprise one or more of polyethylene and polypropylene. Such non-thermoplastic materials may comprise one or more of polyethylene terephthalate, nylon, or aluminium.

The at least one side 8 being of a gusset formation preferably comprises at least one fold. The fold is configured so as to allow the gusset formation to fold to a collapsed configuration, where the front panel 6 and back panel 7 are brought towards each other to reduce the volume of the containment region 10. The fold is also configured to unfold from the collapsed configuration to move the front panel and back panel away from each other so as to increase the volume of the containment region 10. The gusset formation may comprise one or more of such folds. In the collapsed configuration the one or more folds of the gusset formation of each side 8 having a gusset formation preferably extends inwardly into the containment region in its collapsed configuration.

While only at least one side 8 may comprise a gusset formation, in a preferred embodiment both sides 8 have a gusset formation.

In various embodiments the base 9 of the bag may also comprise a base panel which is of a gusset formation.

The openable and re-closeable closure 16 may be of any commonly available cooperating closure. For example, the closure elements 13 and 14 may comprise the two sides of a hook and loop fastener, such as Velcro®. Alternatively, the closure elements 13 and 14 may cooperate together to provide a resilient adhesive closure. Or, as in the preferred form, the closure elements 13 and 14 comprise the halves of a zipper closure, such as a plastic zipper. In other forms, the openable and re-closable closure 16 may be of any other commonly available re-closable closure.

While the openable and re-closeable closure 16 may simply be able to close, in various preferred forms it may provide a sealed closure.

The bag 1 may generally comprise of a back panel 7 and, an opening region 10 of the bag and as an assembly with the back panel 7, a first closure panel 12. Each of the back panel 7 and the first closure panel 12 comprises at a first zone of the opening region 10 a closure member 13, 14. The closure members 13 and 14 are for interfacing together to provide an openable and re-closeable closure 16. The bag has a front panel 6 opposed to the back panel 7. It has two sides 8. At least one of the sides 8 is of a gusseted formation.

The back panel 7, front panel 6, and sides 8 extend between a base region and the opening region 11 to define a containment region 10.

The bag has a first zone where the closure members 13 and 14 are provided, and a second zone of the opening region 11. At the second zone the first closure panel 12 and the back panel 7 are not bonded together and are prevented from heat seal bonding to each other. The second zone is a zone more distal the base region than the first zone.

The prevention from heat seal bonding to each other is a prevention as herein described. Preferably this prevention is provided by a non-heat sealable relationship between the two materials of the first closure panel 12 and the back panel 7 at the second zone.

If this configuration of a bag is heat sealed along the second zone, the first closure panel 12 will be bonded to a corresponding portion of the bag while the first closure panel 12 and back panel 7 are prevented from heat seal bonding to each other. The corresponding portion 22 of the bag is the first closure panel 12 adjacent portions of the front panel 6 and the sides 8 when flattened against the first closure panel 12.

Following such a heat sealing along the second zone, an openable and re-closeable mouth opening of the bag is able to be created between the closure members 13 and 14 of the first closure panel 12 and the corresponding portion 22.

Alternatively, if a first closure panel 12 and second closure panel 27 are provided as an assembly with the back panel, the mouth opening of the bag is able to be created between the closure members 13 and 14 of the first closure panel 12 and second closure panel 27. In this configuration due to the heat sealing along the second zone the first closure panel 12 is bonded to the corresponding portion 22 of the bag, the second closure panel 27 is bonded to the back panel 6, and the first and second closure panels are not bonded to each other.

The present invention also relates to a method of manufacture of a bag 1 for opening and closing by a user. The method comprises a first step providing as a multi-panel assembly a bag comprising a back panel 7 and a front panel 6. The front panel and back panel are sealed at a base 9 of the bag and at two sides 8 extending from the base 9. A first part 12 of an openable and re-closeable closure 16 comprising a first closure element 13 is associated with the back panel 7. The back panel 7 comprises a second part 27 of the openable and re-closeable closure having a second closure element 14 for cooperation with the first closure element 13.

The bag comprises a void region 15 at which the first part and the back panel are prevented from bonding to each other under an application of heat and pressure.

The method further comprises the step of introducing an item of commerce into the package through a first state opening of the bag. The perimeter of the first state opening is defined by the back panel 7, the front panel 6, and the two sides 8.

The first state opening is then closed by the step of applying heat and pressure to the multi-panel assembly between the front panel 6 and the back panel 7 along the void zone 15. This application of heat and pressure causes the second part 27 to be bonded to the back panel 7, and the first part 12 could be bonded to the remaining panels of the multi-panel assembly. This means that a second state opening is able to be created between the first part 12 and the second part 27. The perimeter of the second state opening is defined by the first part 12 and the second part 27 of the openable and re-closeable closure 16.

The invention also relates to an openable and re-closeable closure subassembly of or for a bag.

The closure subassembly 30 comprises a first film 12 and a second film 27. The closure subassembly 30 further comprises two cooperating closure elements 13 and 14 between the first film and the second film. One closure element 13 and 14 is associated with each of the first film 12 and second film 27. The closure elements 13 and 14 are provided at a closure region of the subassembly 30.

The closure subassembly 30 may further comprise a non-bonding region 15 of the inner surfaces of the first film 12 and the second film 27. At the non-bonding region 15 the first film 12 and second film 27 have a non-heat sealable relationship. At the non-bonding region 15 an alpha surface of either film 12, 27 may be heat sealed to a third film without a heat seal bonding of the inner surfaces of the first film 12 and second film 27 to each other.

The closure subassembly 30 preferably comprises a bonding region 24 more distal the closure region than the non-bonding region 15. At the bonding region 24, the inner surfaces of the first film 12 and second film 27 have a heat sealable relationship, such that they may be heat sealed to each other.

The non-bonding region is preferably adjacent to the closure region. Either or both of the first film 12 and the second film 27 may comprise a laminate of a plurality of sub films.

In some embodiments the first closure panel 12 and second closure panel 27 of a closure subassembly 30, or first closure panel 12 and back panel 7 of a bag 1, may extend further towards the base 9 of the bag than the closure elements 13 and 14 of the openable and re-closable closure 16. These extension portions 35 and 36 first closure panel 12 and second closure panel 27 or back panel 7, respectively, may be bonded together to provide a further closure 37 of the bag.

Figure 24A:
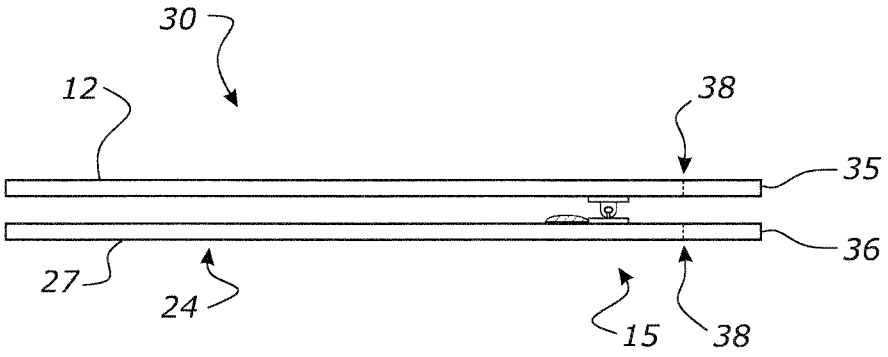
FIG. 24A shows an embodiment of a closure subassembly.

FIG. 24A shows an example of such a configuration wherein a closure subassembly 30 has two extension portions 35 and 36. The extension portions 35 and 36 are more distal the non-bonding zone 15 than the openable and re-closable closure 16. The extension portions 35 and 36 are able to be bonded together under an application of heat and pressure, and in particular are preferably able to be heat sealed together.

Figure 24B:
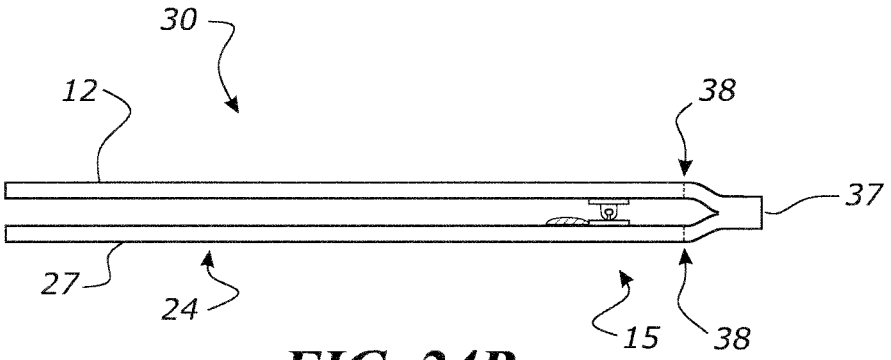
FIG. 24B shows a further view the assembly of FIG. 24A.

FIG. 24B shows the assembly of FIG. 24A, wherein the extension portions 35 and 36 have been bonded together to form a further closure 37.

Figure 25A:
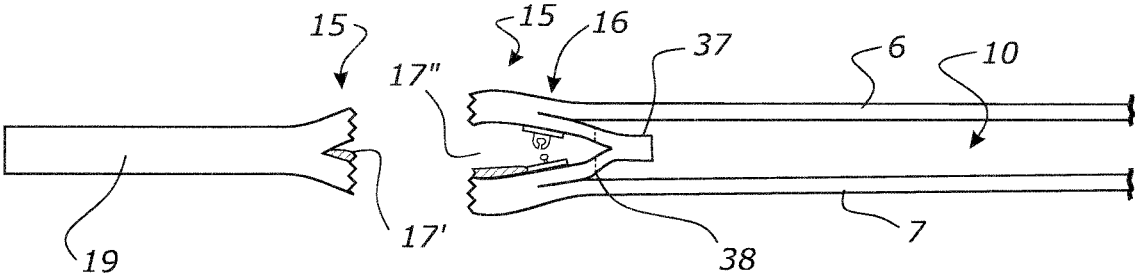
FIG. 25A shows the closure subassembly of FIGS. 24A and 23B as part of a bag.

FIG. 25A shows the closure subassembly of FIG. 24B as part of a bag 1. The bag is shown with the header 19 removed, and open at the openable and re-closable closure 16, but with the further closure 37 still closed.

Figure 25B:
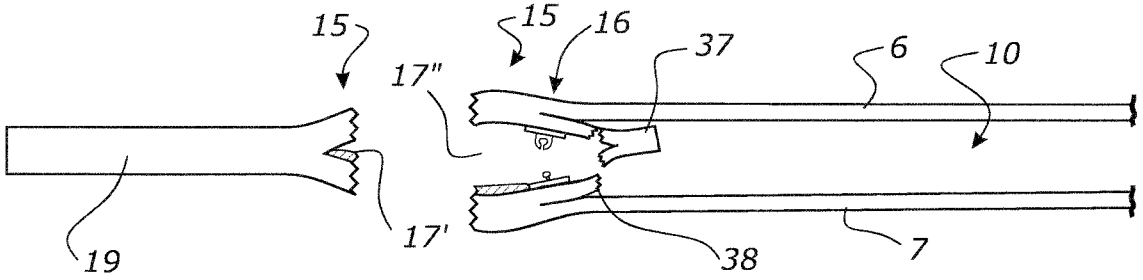
FIG. 25B shows the configuration of FIG. 25A wherein the containment region of the bag is accessible.

FIG. 25B shows the configuration of FIG. 25A, but where the extension portions 35 and 36 have been torn at the lines of weakness 38 to allow access to the containment region 10 of the bag.

It may be desirable to leave the extension portions 35 and 36 at least partially connected to the bag, to prevent their falling into the containment region 10. In such a configuration for example only one of the extension portions 35 or 36 may comprise a line of weakness 38, so that upon tearing at the line of weakness the further closure 37 remains attached to the bag by the other extension portion 35 or 36.

In other configurations, the further closure 37 may not be bypassed by tearing at the lines of weakness 38 as shown in FIG. 25B, but rather the further closure 37 may be separated. For example, the bond of the further closure 37 may be provided by a separable adhesive bond. In such a configuration it may be desirable that the adhesive is tamper-evident, so as to not be able to return to its original unopened state following its first opening.

The closure subassembly 30 of FIG. 24A may be provided with its extension portions 35 and 36 already bonded together, as is seen in FIG. 24B. Alternatively, the extension portions 35 and 36 may not be already bonded together, but may be bonded together during either a) the association of the closure subassembly 30 with the back panel 9 of the bag, or b) during the step of transferring the first closure panel 12 to the front panel 6 of the bag.

Where the extension portions 35 and 36 are bonded together by either of (a) or (b) above, one or both of the extension portions 35 and 36 may bonded to the respective adjacent back panel 7 or front panel 6.

Alternatively, where the extension portions are bonded together by either of (a) or (b) above, the relationship of either or both of i) the first closure panel 12 and front panel 6, and ii) the second closure panel 12 and back panel 7, may be such that they do not bond under an application of heat and pressure, such as a heat sealing.

While in various preferred forms the further closure may be provided by a heat seal bonding of the extension portions 35 and 36 together, in other embodiments the further closure may be provided by an adhesive. The adhesive may be either able to be separated by a user, or may permanently bond the extension portions 35 and 36 together.

Whatever the configuration, the further closure 37 may comprise one or more lines of weakness 38. The bonding of the extension portions 35 and 36 is preferably more distal the non-bonding zone 15 than the one or more lines of weakness 38. The line or lines of weakness 38 may present a weakened portion of either or both of the extension portions 35 and 36, such that either or both may be torn at that point to allow access to the containment region 10 of the bag past the further closure 37.

Where the further closure 37 does not comprise a line or lines of weakness 38, the further closure 37 may be able to be torn apart to allow access to the bag, or adjacent portions of either the first closure panel 12 or second closure panel 27 may be able to be torn to allow access to the bag.

A further closure 37 may be desirable for a number of reasons, including to seal the containment region 10 of the bag, and to provide further resistance to tampering or a tamper-evident indicator for a user.

Particularly where the bag 1 does not comprise a sealed header 19, a further closure 37 may be desirable to provide a secure sealing of the bag following its filling. While in some forms the openable and re-closable closure 16 may seal the bag, it may not be provided in a closed configuration and thus would not seal the contents of the bag. Additionally, the openable and re-closable closure 16 does not provide any resistance to or indication of tampering with the contents of the bag.

Even where the bag comprises a header 19, it may be desirable to provide a further level of sealing, or further assurance of the safety of the contents of the bag from tampering by providing a further closure 37.

The present invention also relates to an openable and resealable closure subassembly 30 as herein described, as part of a bag 1 as also herein described.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

The invention claimed is:

1. A bag comprising:

a front panel and back panel sealed at a base of the bag and two sides extending from the base to define a containment region, the bag being open or openable at an opening region opposite the base and where a multi-panel assembly is provided comprised of said front panel and back panel, at least one side being of a gusset formation, a first closure panel comprising a closure element having a base at one face of the first closure panel, the closure element being configured for cooperating with a closure element associated with the back panel to provide an openable and re-closable closure of the containment region, the first closure panel having another face opposite the one face that is bondable to the front panel, and a non-bonding zone located on the one face of the closure panel between the one face of the first closure panel and the back panel, or located on the front panel between the one face of the first closure panel and the back panel, at which the back panel and the one face of the first closure panel are prevented from bonding to each other directly under an application of heat and pressure, the non-bonding zone extending along the length of the openable and re-closable closure, and more distal of the base of the bag than the openable and re-closable closure, wherein in a first mode the first closure panel is associated with the back panel, and the containment region is accessible through a first mode opening the perimeter of which is defined by the front panel and back panel and two sides, and wherein in a second mode, following an application of heat and pressure along the non-bonding zone to the back panel, the first closure panel, and the front panel of the multi-panel assembly, the first closure panel is bonded to the front panel and the back panel of the multi-panel assembly to define a removable header comprised of a portion of the front and the back panels, and a void in which the non-bonding zone resides, the removable header being located at a position more distal from the base than the non-bonding zone, and the void being defined by two unconnected pieces with substantially abutting adjacent edges to define a line of weakness at the void along which the multi-panel assembly is tearable to remove the header, such that a second mode opening to the containment region is able to be created between the closure element of the back panel and the closure element of the first closure panel to provide access to the openable and re-closable closure of the containment region, and the perimeter of the second mode opening that allows access to the containment region is defined by and between the two closure elements, and wherein each panel comprises multiple plies, the multiple plies comprise at least a first ply and a second ply, wherein the second ply is less stretchable than the first ply, and the first ply is bondable to another panel of the multi-panel assembly under an application of heat and pressure.

2. The bag as claimed claim 1, wherein the remainder of the multi-panel assembly to which the first closure panel is bonded comprises a folded portion of the at least one side being of a gusseted formation directly adjacent the first closure panel and a remainder of the front panel not covered by the folded portion of each at least one side being of a gusset formation.

3. The bag as claimed in claim 1, wherein each of the two sides are of a gusset formation.

4. The bag as claimed in claim 3, wherein the remainder of the multi-panel assembly to which the first closure panel is bonded comprises a) a portion of the gusseted formation of each side at respective periphery of the first closure panel, and b) a remainder of the front panel not occluded by the gusset formations of the two sides.

5. The bag as claimed in claim 1, wherein the closure elements of the openable and re-closable closure are prevented from bonding to each other under an application of heat and pressure.

6. The bag as claimed in claim 1, wherein the perimeter of the second mode opening is smaller than the perimeter of the first mode opening.

7. The bag as claimed in claim 1, wherein the prevention of the back panel and the first closure panel from bonding to each other is provided by a separator at the non-bonding zone between the back panel and the first closure panel, the separator insulating the back panel and the first closure panel at the non-bonding zone from bonding with each other.

8. The bag as claimed in claim 1, wherein the prevention of the back panel and the first closure panel from bonding to each other at the non-bonding zone is provided by a material relationship between the back panel and the first closure panel which does not bond under heat and pressure.

9. The bag as claimed in claim 8, wherein the material relationship is provided by either or both of the back panel and the first closure panel at the non-bonding zone comprising a non-thermoplastic material.

10. The bag as claimed in claim 9, wherein the non-thermoplastic material is provided as a surface addition to either or both of the back panel and the first closure panel at the non-bonding zone.

11. The bag as claimed in claim 9, wherein the non-thermoplastic material is provided integral with either or both of the first closure panel and the second closure panel at the non-bonding zone.

12. The bag as claimed in claim 9, wherein the non-thermoplastic material is provided as a replacement of an outer ply of either or both of the back panel and the first closure panel at the non-bonding zone.

13. The bag as claimed in claim 1, wherein the back panel comprises a second closure panel, the second closure panel comprising the closure element associated with the back panel, and the prevention of the first closure panel and the back panel from bonding to each other comprises a prevention of the first closure panel and second closure panel from bonding to each other at a void zone.

14. The bag as claimed in claim 13, wherein the second closure panel is heat-seal bonded to the back panel.

15. The bag as claimed in claim 14, wherein the second closure panel is heat-seal bonded to the back panel at either or both of a) the non-bonding zone, and b) a zone more distal the base of the bag than the non-bonding zone.

16. The bag as claimed in claim 13, wherein the prevention of the first closure panel and the second closure panel from bonding to each other is provided by a separator at the non-bonding zone between the back panel and the first closure panel, the separator insulating the first closure panel and the second closure panel at the non-bonding zone from bonding with each other.

17. The bag as claimed in claim 13, wherein the prevention of the first closure panel and the second closure panel from bonding to each other at the non-bonding zone is provided by a material relationship between the first closure panel and the second closure panel which does not bond under heat and pressure.

18. The bag as claimed in claim 17, wherein the material relationship is provided by either or both of the first closure panel and the second closure panel at the non-bonding zone comprising a non-thermoplastic material.

19. The bag as claimed in claim 18, wherein the non-thermoplastic material is provided as a surface addition to either or both of the first closure panel and the second closure panel at the non-bonding zone.

20. The bag as claimed in claim 18, wherein the non-thermoplastic material is provided integral with either or both of the first closure panel and the second closure panel at the non-bonding zone.

21. The bag as claimed in claim 20, wherein the non-thermoplastic material is provided as a replacement of an outer ply of either or both of the first closure panel and the second closure panel at the non-bonding zone.

22. The bag as claimed in claim 1, wherein each panel of the multi-panel assembly, being the back panel, the front panel, the at least one side being of a gusset formation, the first closure panel, or the second closure panel, comprise two opposed major surfaces.

23. The bag as claimed in claim 1, wherein the at least one side being of a gusset formation comprises the second ply located between the first ply and a third ply, wherein the third ply is not bondable to another panel of the multi-panel assembly under an application of heat and pressure, and the at least one side being of a gusset formation is configured so the third ply faces away from the containment region.

24. The bag as claimed in claim 1, wherein the application of heat and pressure along the non-bonding zone prior to the second mode comprises an application of heat and pressure across the entire width of the first closure panel at the opening region.

25. The bag as claimed in claim 1, wherein each panel of the multi-panel assembly comprises a plastic material.

26. The bag as claimed in claim 25, wherein a ply of a panel of the multi-panel assembly which is prevented from bonding or is not bondable to another panel of the multi-panel assembly under an application of heat and pressure have a non-heat-sealable relationship.

27. The bag as claimed in claim 1, wherein the at least one side being of a gusset formation comprises at least one fold configured so as to allow the gusset formation to a) fold to a collapsed configuration wherein the front panel and back panel are brought towards each other to reduce the volume of the containment region, and b) unfold from the collapsed configuration to move the front panel and back panel away from each other to increase the volume of the containment region.

28. The bag as claimed in claim 27, wherein in the second mode following the application of heat and pressure along the non-bonding zone one half of each side being of a gusset formation is bonded to the first closure panel and the other half of the gusset formation is bonded to the front panel and an opposing surface of each side being of a gusset formation is bonded to itself.

29. The bag as claimed in claim 1, in the first mode, the first closure element is coupled to the closure element associated with the back panel, and the first closure panel extends over the non-bonding zone and is bonded to the back panel.

* * * * *